US006640592B2

(12) United States Patent
Vickers

(10) Patent No.: US 6,640,592 B2
(45) Date of Patent: Nov. 4, 2003

(54) KEY OPERATED LATCH WITH COMBINED ROTATIONAL AND TRANSLATIONAL LATCHING ACTION

(75) Inventor: James H. Vickers, Media, PA (US)

(73) Assignee: Southco, Inc., Concordville, PA (US)

( * ) Notice: Subject to any disclaimer, the term of this patent is extended or adjusted under 35 U.S.C. 154(b) by 0 days.

(21) Appl. No.: 09/850,969

(22) Filed: May 8, 2001

(65) Prior Publication Data

US 2002/0166353 A1 Nov. 14, 2002

(51) Int. Cl.[7] ..... E05B 65/06; E05B 17/04

(52) U.S. Cl. ..... 70/83; 70/127; 70/128; 70/379 R; 70/492; 292/64

(58) Field of Search ..... 70/83, 127, 128, 70/379 R, 379 A, 380, 492, DIG. 42, DIG. 78, DIG. 79; 292/58, 63, 64–68, 57, 59

(56) References Cited

U.S. PATENT DOCUMENTS

| | | | | |
|---|---|---|---|---|
| 1,907,625 | A | 5/1933 | Vogt | 70/100 |
| 2,049,742 | A | 8/1936 | Lowe | 70/379 R |
| 3,402,958 | A | 9/1968 | Barry | 292/62 |
| 4,556,244 | A | 12/1985 | Bisbing | 292/65 |
| 4,583,775 | A | 4/1986 | Bisbing | 292/64 |
| 4,763,935 | A | 8/1988 | Bisbing | 292/66 |
| 4,878,367 | A | 11/1989 | Bisbing | 70/491 |
| 5,076,080 | A | 12/1991 | Fuss et al. | 70/125 |
| 5,165,738 | A | 11/1992 | McCormack | 292/67 |
| 5,263,348 | A | 11/1993 | Wittwer | 70/379 R |

FOREIGN PATENT DOCUMENTS

FR 2006184 12/1969

OTHER PUBLICATIONS

Southco Handbook 2000 by Southco, Inc., 1999, pp. 28, 29, 36, 37, 112 and 113.

Product Description by Strattec Security Corporation, dated 1997.

Southco Latches and Hardware Handbook 45 NA, by Southco, Inc., 1995, pp. E–8, E–9, G–16, and G–17.

*Primary Examiner*—Lloyd A. Gall
(74) *Attorney, Agent, or Firm*—Paul & Paul

(57) ABSTRACT

A key operated latch includes a housing which supports a lock plug, a motion control sleeve, and a sleeve-like cam therein. The cam rotates with the lock plug, while the motion control sleeve is stationary. The cam has at least one cam slot, and the motion control sleeve has at least one motion control slot. A shaft extends outward from the housing and has at least one projection which is engaged with both the cam slot and the motion control slot. The cam slot and the motion control slot are configured such that rotation of the lock plug imparts a sequence of rotational and axial movements to the shaft. A latching member attached to the shaft, moves between a latched position and an unlatched position in a sequence of axial and rotational motions in order to selectively secure a door, panel, or the like in the closed position. Also disclosed are additional embodiments that incorporate a wing knob or that have a lock plug sleeve and a motion control sleeve that are combined into a single part of one-piece construction. In one of the embodiments having a wing knob the wing knob freewheels without opening the latch when the lock plug is in the locked configuration.

6 Claims, 35 Drawing Sheets

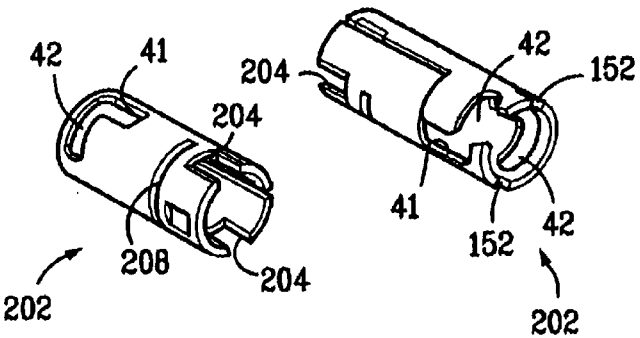
FIG. 49
FIG. 48
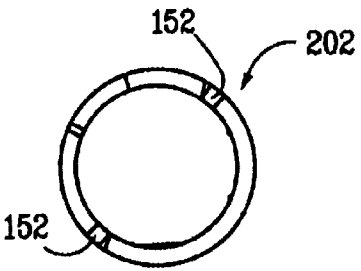
FIG. 47B
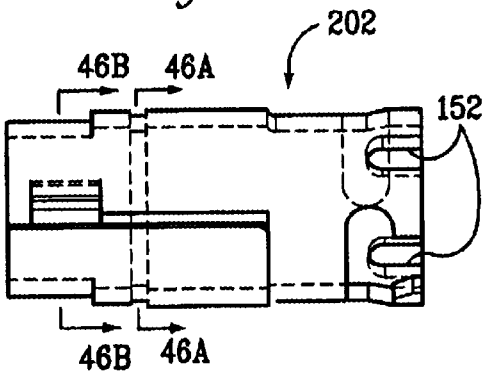
FIG. 46
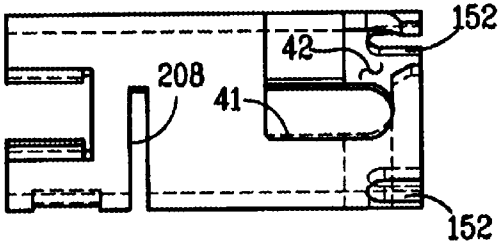
FIG. 47
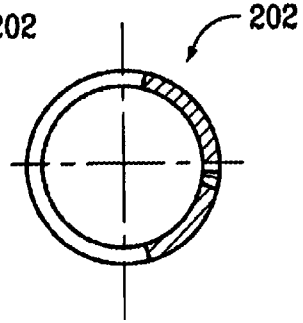
FIG. 46A
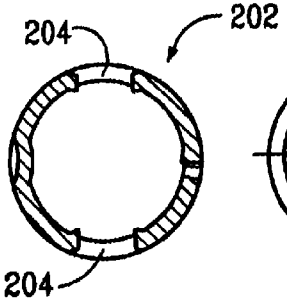
FIG. 46B
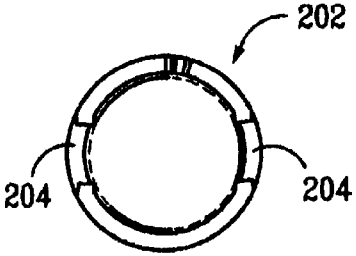
FIG. 47A FIG. 87A
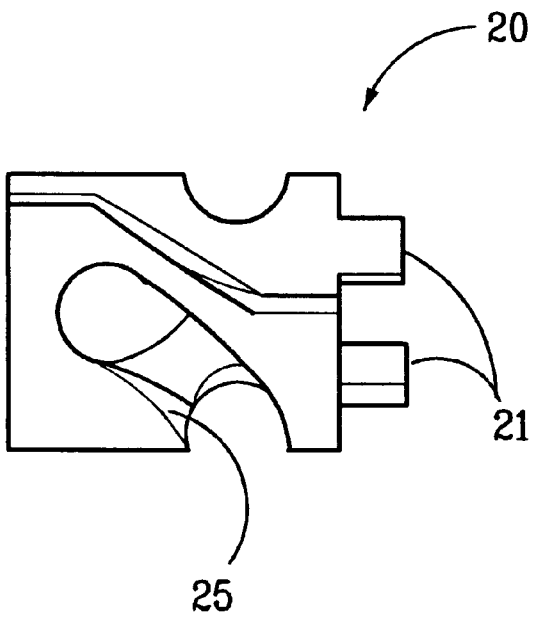
FIG. 87B
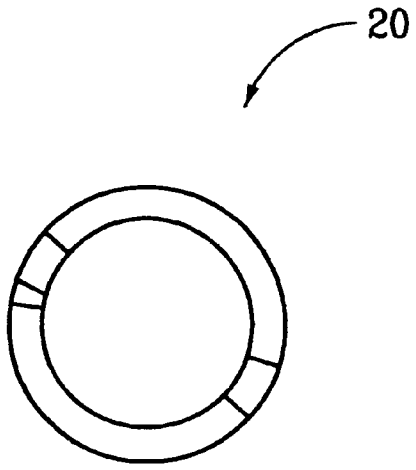
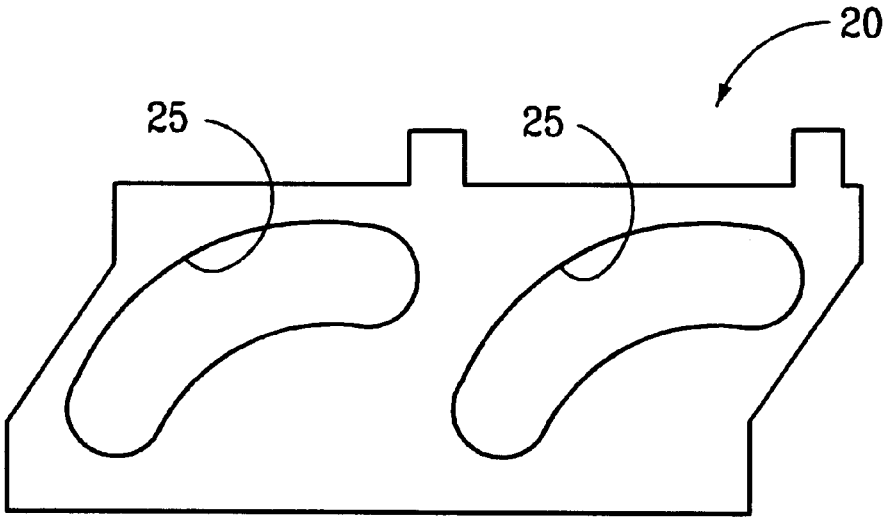
FIG. 87C

KEY OPERATED LATCH WITH COMBINED ROTATIONAL AND TRANSLATIONAL LATCHING ACTION

BACKGROUND OF THE INVENTION

1. Field of the Invention

The present invention relates generally to latching devices and more particularly to latching devices for securing a first member such as a door, panel or the like in a closed position relative to a second member such as a corresponding door, panel or frame.

2. Brief Description of the Prior Art

Various types of latching devices for use in securing a first closure member such as a door, panel or the like in a closed position relative to a corresponding second closure member such as a door, panel or frame are known. Some types incorporate a pawl or similar latching member that is actuated to engage a closure member for latching. In particular, latches have been proposed which operate to move the latching member both rotationally and translationally to engage a closure member for latching. For example, U.S. Pat. No. 5,165,738, issued to Edward McCormack on Nov. 24, 1992, U.S. Pat. No. 4,878,367, issued to Robert H. Bisbing on Nov. 7, 1989, U.S. Pat. No. 4,583,775, issued to Robert H. Bisbing on Apr. 22, 1986, and U.S. Pat. No. 4,556,244, issued to Robert H. Bisbing on Dec. 3, 1985, all show latching mechanisms with a combined rotational and translational latching action. However, none of the references cited previously teach or suggest the unique structural features of the key operated latch of the present invention.

SUMMARY OF THE INVENTION

The present invention is generally directed to a key operated latch for use with a door, panel or the like. The latch includes a housing having a bore, a first end, and a second end. A lock plug, a lock plug sleeve, a motion control sleeve, and a sleeve-like cam are received within the bore of the housing. The lock plug sleeve and the motion control sleeve are supported within the housing such that they are stationary relative to the housing. The lock plug is positioned coaxially with the lock plug sleeve and is selectively rotationally movable relative to the lock plug sleeve by using a key. The sleeve-like cam is coupled to the lock plug such that it rotates with the lock plug. The sleeve-like cam has at least or cam slot, and the motion control sleeve has at least one motion control slot. The latch further including a shaft which is positioned at least in part within the housing, with a portion of the shaft extending outward from the second end of the housing. The shaft has at least one projection which is engaged with both the cam slot and the motion control slot. The cam slot and the motion control slot are configured such that rotation of the lock plug imparts movement to the shaft which is a sequence of movements including a rotational movement and an axial movement. A latching member is supported by the shaft outside the housing such that the latching member and the shaft move as a unit. Thus, the latching member moves between a latched position and an unlatched position in a sequence of axial and rotational motions in order to selectively, releasably secure the door, panel, or the like in the closed position.

Accordingly, it is an object of the present invention is to provide a novel key operated latch.

Another object of the present invention is to provide a novel latch of the type incorporating a pawl or similar member and which is actuated through operation of a key.

Yet another object of the present invention is to provide a novel key operated latch where the pawl moves both rotationally and axially.

Still another object of the present invention is to provide a novel latch which applies a compressive force between first and second closure members.

These and other objects of the present invention will become more readily apparent when taken into consideration with the following description and the attached drawings.

BRIEF DESCRIPTION OF THE DRAWINGS

FIGS. 46–49 are views of the unitary motion control sleeve and lock plug sleeve of the latch assembly of FIG. 40.

FIGS. 87A–87C are views of the cam of the latch assembly of FIG. 65.

DETAILED DESCRIPTION OF THE PREFERRED EMBODIMENTS

Figure 1:
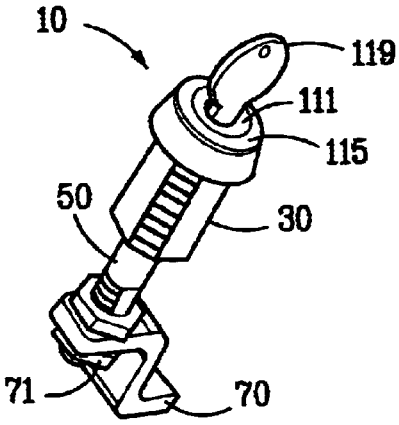
FIGS. 1–7 are views of a latch assembly in accordance with an embodiment of the present invention.
Figure 2:
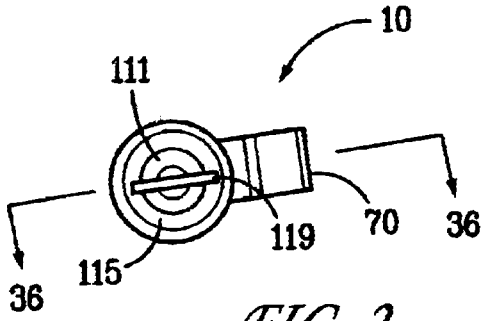
Figure 3:
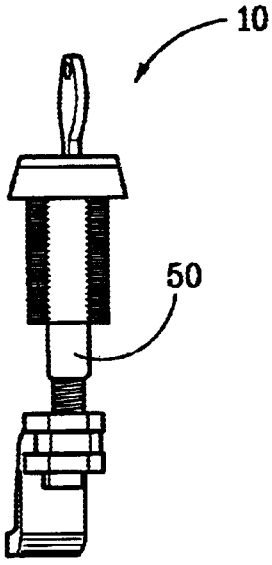
Figure 4:
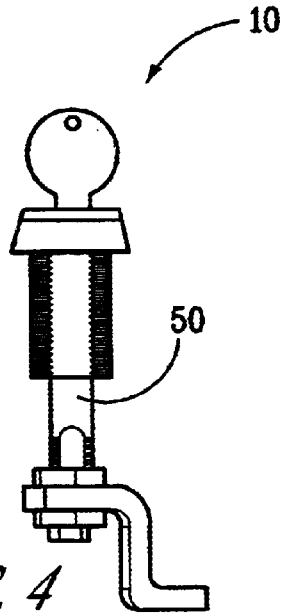
Figure 5:
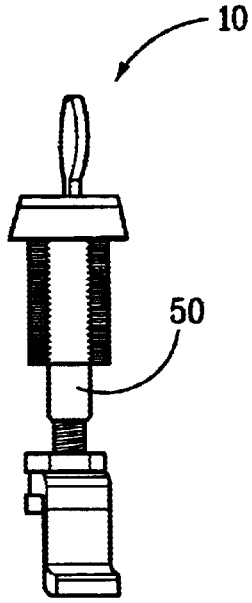
Figure 6:
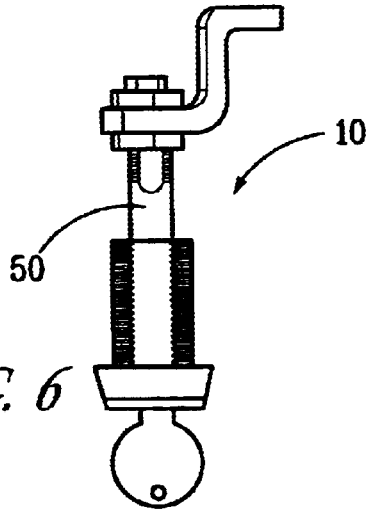
Figure 7:
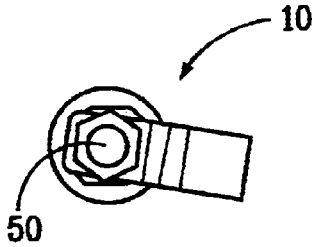
Figure 8:
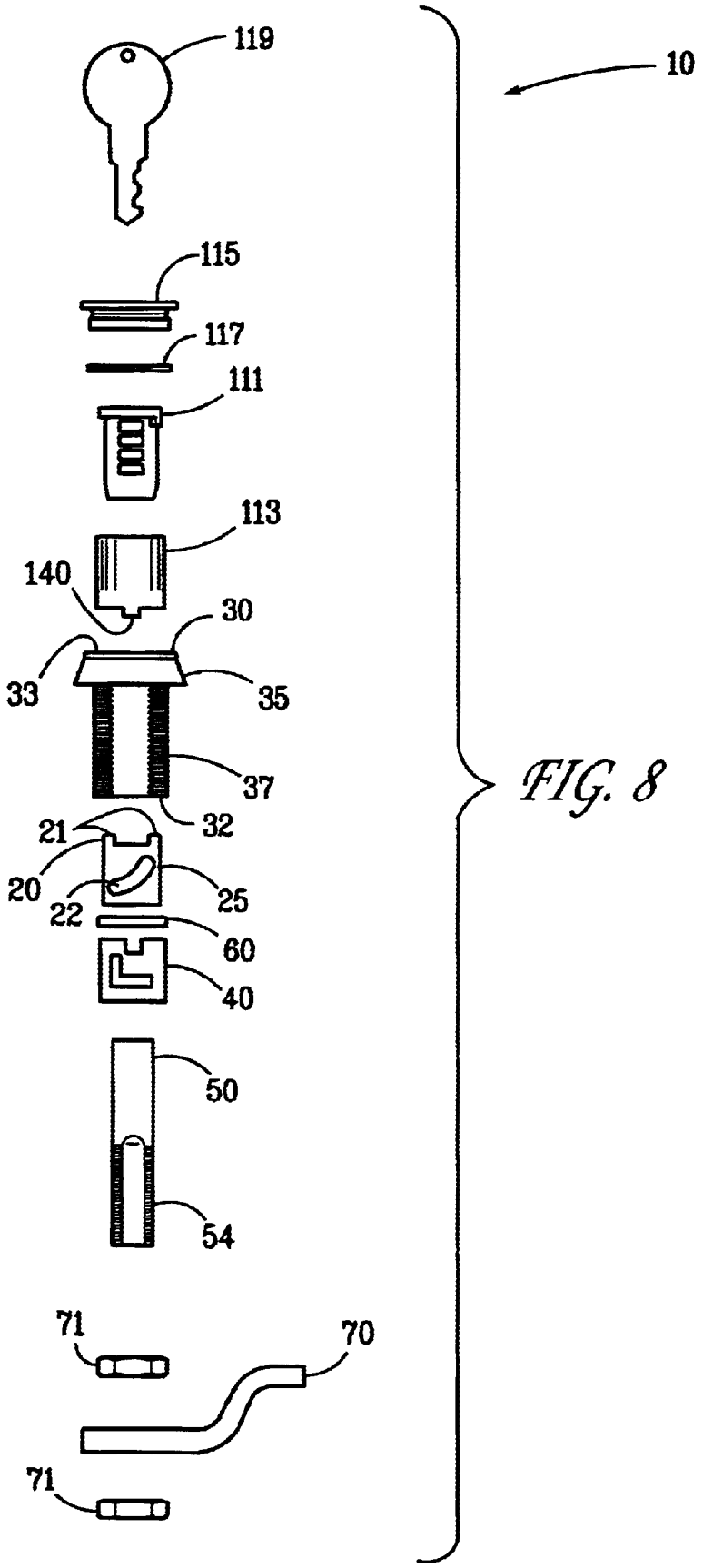
FIG. 8 is an exploded view of the latch assembly of FIGS. 1–7.
Figure 9:
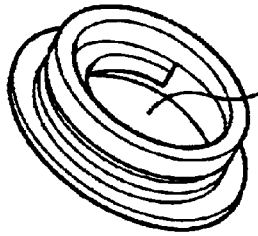
FIGS. 9–16 are views of a bushing, slightly enlarged, of the latch assembly of FIG. 8.
Figure 10:
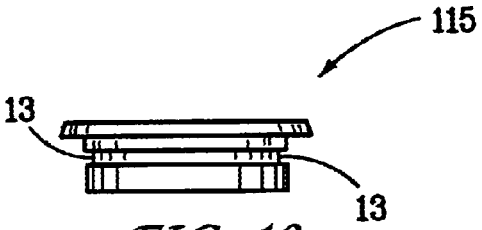
Figure 11:
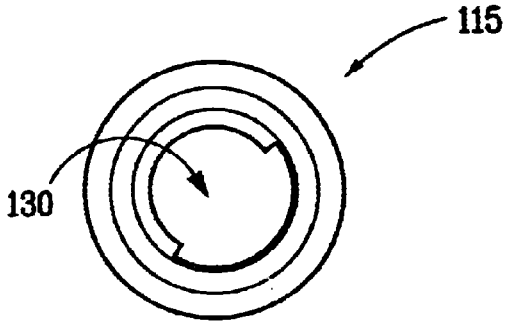
Figure 12:
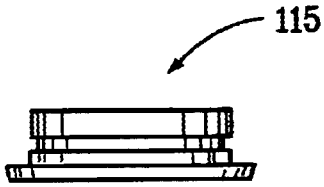
Figure 13:
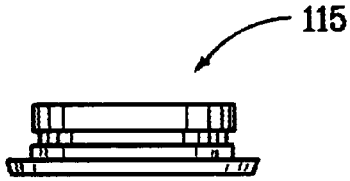
Figure 14:
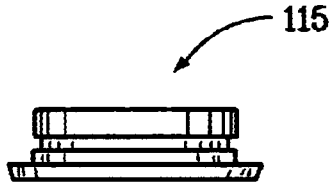
Figure 15:
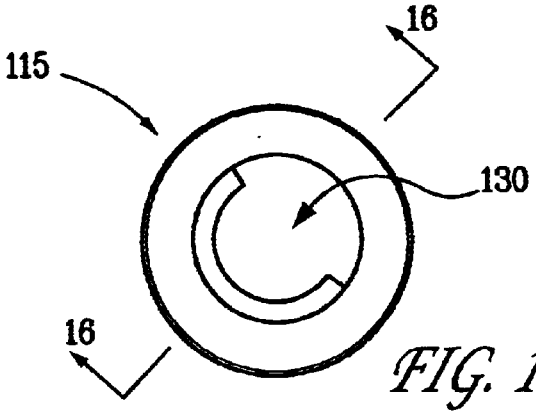
Figure 16:
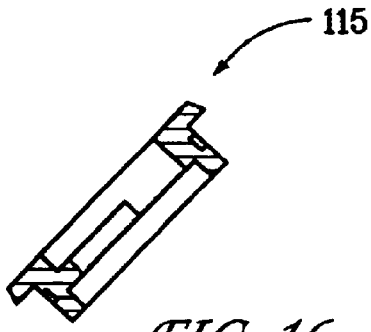
Figure 17:
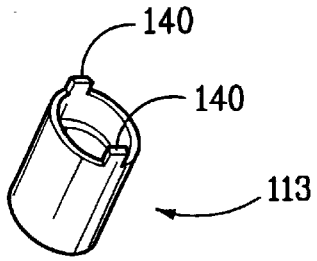
FIGS. 17–24 are views of a lock plug sleeve, slightly enlarged, of the latch assembly of FIG. 8.
Figure 18:
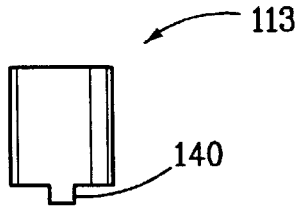
Figure 19:
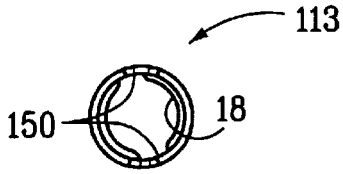
Figure 20:
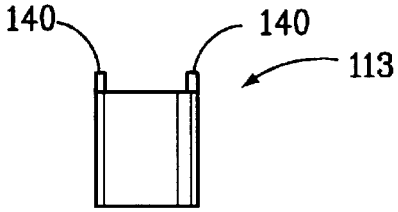
Figure 21:
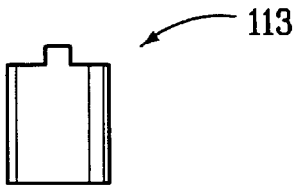
Figure 22:
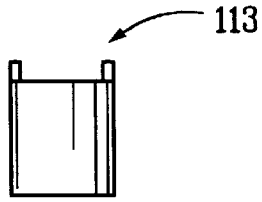
Figure 23:
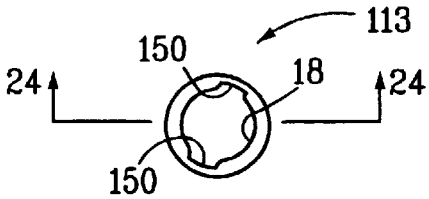
Figure 24:
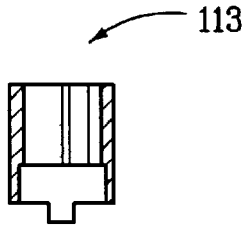
Figure 25:
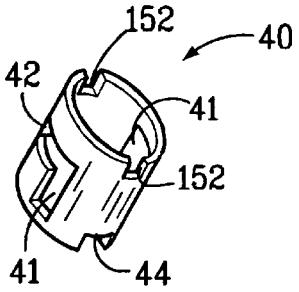
FIGS. 25–31 are views of a motion control sleeve, slightly enlarged, of the latch assembly of FIG. 8.
Figure 26:
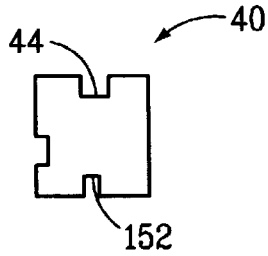
Figure 27:
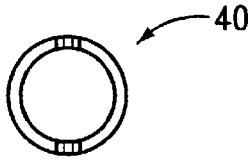
Figure 28:
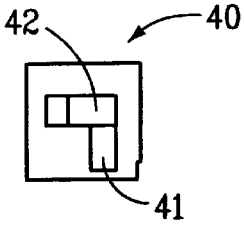
Figure 29:
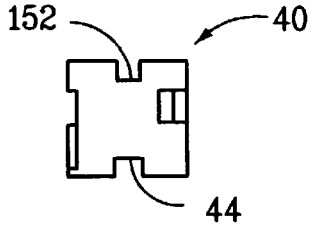
Figure 30:
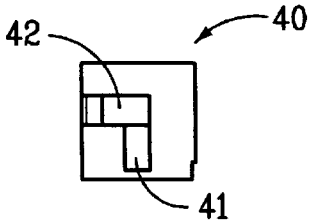
Figure 31:
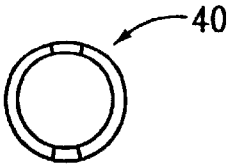
Figure 32:
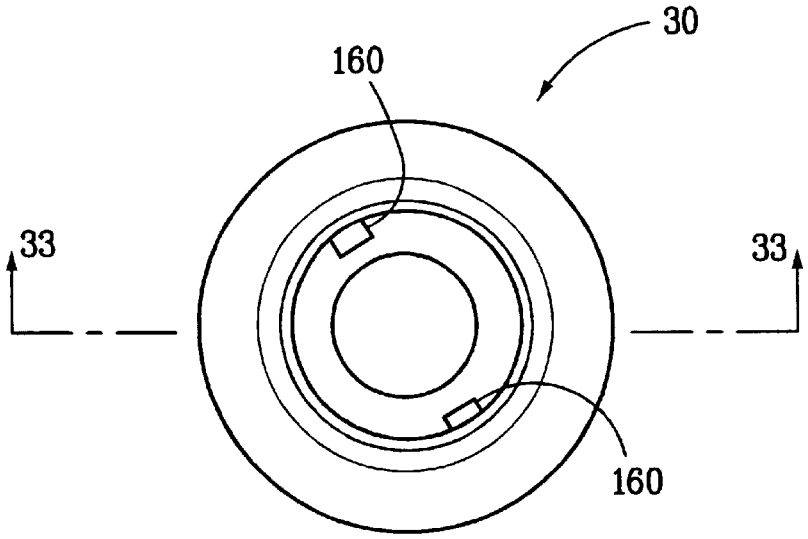
FIGS. 32 and 33 are views of a housing, slightly enlarged, of the latch assembly of FIG. 8.
Figure 33:
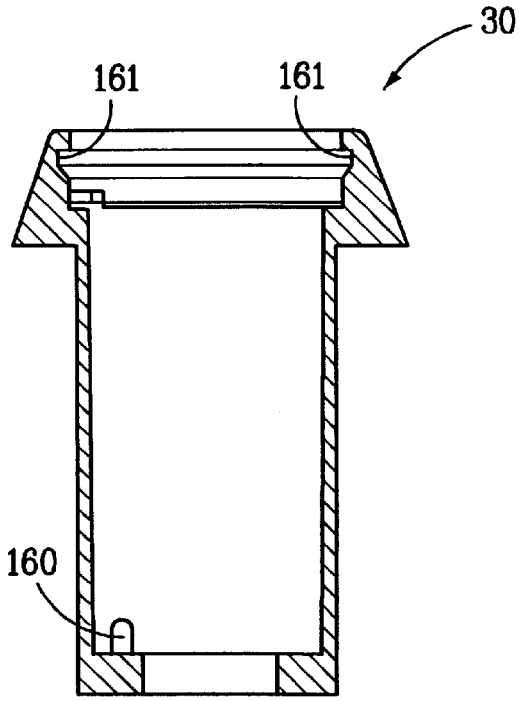
Figure 34:
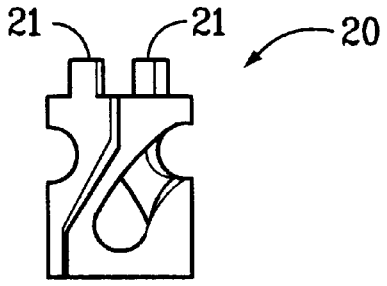
FIG. 34 is a side elevational view of a cam, slightly enlarged, of the latch assembly of FIG. 8.
Figure 35:
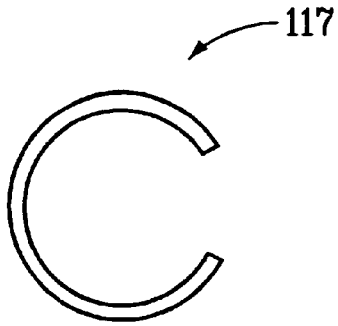
FIG. 35 is a top plan view of a retainer, slightly enlarged, of the latch assembly of FIG. 8.
Figure 36:
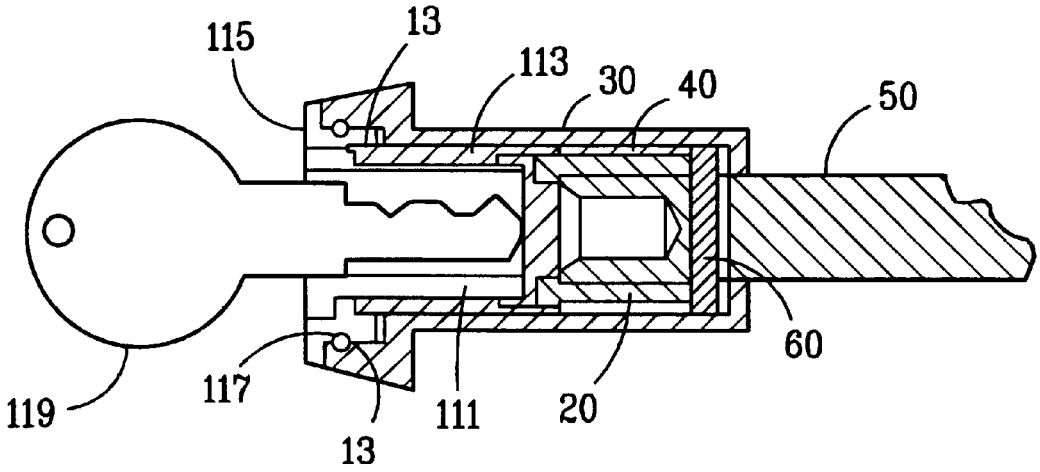
FIG. 36 is a cross sectional view of the latch assembly of FIGS. 1–7 taken along the line 36–36 of FIG. 2.
Figure 37:
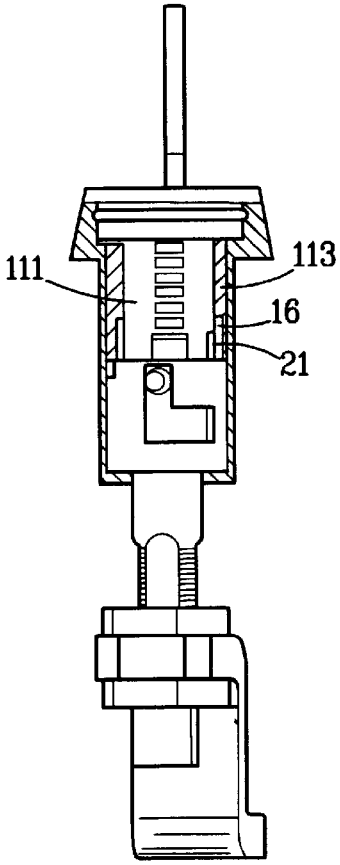
FIGS. 37–39 are side elevational views of the latch assembly of FIGS. 1–7, slightly enlarged, with the housing and sleeve portions in section and the latchassembly being shown in a closed or latched position in FIG. 37, in an open or unlatched position in FIG. 39 and in a transitional position between the closed and open positions in FIG. 38.
Figure 38:
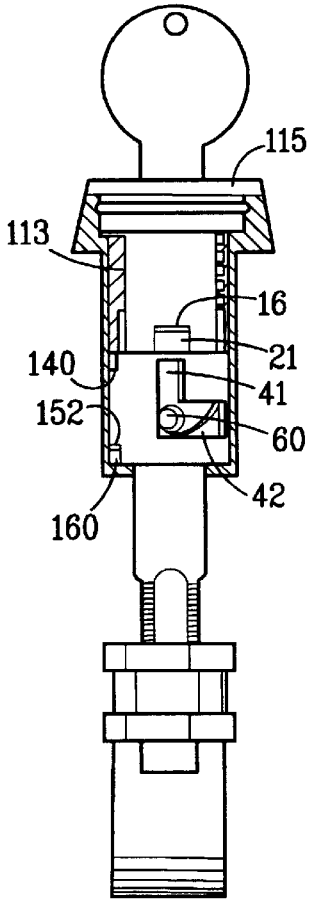
Figure 39:
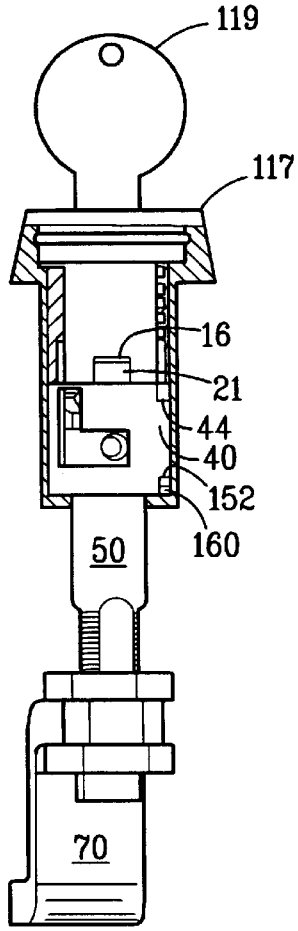

The present invention is directed to a key operated latch that has broad application and may be used with a wide variety of closure members, such as a door or the like, for releasably securing a closure member in the closed position.

Illustrated in the figures is one embodiment of a latch in accordance with the present invention. The particular latch illustrated in the present embodiment is similar in many aspects to a latch shown, described and claimed in U.S. Pat. No. 4,583,775('755 Patent) entitled "Latch Assembly Having Pull-Up Action", which is incorporated by reference herein. For the sake of brevity, emphasis will be made in the following description to the features in the present embodiment which differ from that set forth in the '775 Patent.

As illustrated in the figures, the latch assembly 10 in accordance with the present embodiment includes, as portions thereof, a housing 30, a shaft 50 having an end 54, fastening means comprising in this embodiment a latching pawl 70 mounted on the threaded end of the shaft 50 as by mounting nuts 71, and actuating means comprising in this embodiment a sleeve-like cam 20, a motion control sleeve 40, a cross-pin 60, a lock plug 111, a lock plug sleeve 113, a bushing 115, a retaining ring 117 and a key 119, the details of which will be described below.

In the present embodiment, the latching pawl 70 is movable rotationally by shaft 50 and is also moveable by shaft 50 axially in the longitudinal direction of the shaft. In operation, the latch assembly 10 is mounted in an opening through one member, such as a closure member, and the pawl is moved to engage a second member, such as a corresponding frame. To latch the closure member to the frame, the latching pawl 70 is first rotated to a position such that it is in line with the frame member. The latch pawl 70 is then moved longitudinally so that it engages the edge of the frame. The shaft 50 is moved rotationally and also longitudinally by means of the actuating means.

The lock plug 111 is generally cylindrical and in the nature of a conventional lock plug including a key access opening and an array of wafers that retract upon insertion of the key 119. The lock plug sleeve 113 is also generally cylindrical and includes a bore 18 generally cylindrical in configuration and which receives the lock plug 111. The bushing 115 comprises a generally annular member in this embodiment including an opening 130 therethrough and operates to retain the internal components, including the lock plug 111, lock plug sleeve 113, sleeve-like cam 20, motion control sleeve 40 and cross-pin 60. The retaining ring 117 is also a generally annular member and operates to hold the foregoing components of the actuating means within the housing 30.

The housing 30 in the present embodiment is a generally elongate component having a first end, a second end, a bore extending longitudinally through the housing 30 and an outer surface. The second end 32 of housing 30 has a central opening, contiguous with the bore of the housing 30, through which the shaft 50 passes. As used herein, the distal end of a component part refers to that end of the component part which is located farthest from the first end of the housing 30, when the latch 10 is fully assembled, while the proximal end of a component part is the end closest to the first end of the housing 30, again when the latch 10 is fully assembled. In the present embodiment, the distal ends of the motion-control sleeve 40 and sleeve-cam 20 abut against the end wall surrounding the central opening in the second end 32 of the housing 30. The lock plug 111 and lock plug sleeve 113 are positioned within the bore of the housing 30 adjacent to the first end 33 of the housing 30. The outer surface of the housing 30 includes a flanged first portion 35 adjacent to the first end 33. The outer surface of the housing 30 also includes a second portion 37. The second portion 37 of housing 30 is provided with interrupted screw threads along a portion of the outer surface thereof. The screw threads on the outer surface of the second portion 37 of the housing 30 are interrupted by four flats formed on the outer surface of the housing 30. The flats formed on the outer surface of the housing 30 prevent the rotation of the housing 30 when the key 119 is used to turn the lock plug 111, once the latch 10 is installed in a closure member such as a door or the door's frame. The interrupted threads on the outer surface of the housing 30 are engaged by a nut to secure the latch 10 in place, once the latch 10 is installed in a closure member such as a door or the door's frame.

In the present embodiment, the lock plug 111 is rotatable within the housing 30 and is prevented from movement in the axial direction, i.e. along the longitudinal axis of the housing 30, by the retaining ring 117. The retaining ring 117 is received within grooves 13 and 161, which are located in the bushing 115 and the housing 30, respectively, and are in registry with one another. As a result, the bushing 115 and retaining ring 117 rotate on rotation of lock plug 111. In addition, means are provided between the lock plug 111 and cam 20 for providing for the rotation of the cam 20 on rotation of the lock plug 111. In the illustrated embodiment, the distal end of the lock plug 111 is provided with a pair of notches 16 which receive ears 21 projecting axially from the proximal end of the cam 20. Thus, when lock plug 111 is rotated, as by the key 119, the sleeve-like cam 20 is also rotated. The sleeve-like cam 20 is provided with at least one and, in the present embodiment, a pair of cam slots 25 spaced 180° apart circumferencially. Each of the slots 25 run in a direction which has both circumferencial and axial components.

The lock plug sleeve 113 in this embodiment is received in housing 30 in a substantially fixed rotational position. As illustrated, the lock plug 111 is substantially surrounded by lock plug sleeve 113, which operates to substantially center the lock plug 111 within the opening in the housing 30. In addition, means are provided between lock plug sleeve 113 and lock plug 111 to provide locked and unlocked conditions of the latch assembly 10. In this embodiment, the lock plug sleeve 113 includes a groove 150 on its inner surface that cooperates with the wafers of lock plug 111 in order to provide the locked and unlocked conditions of the latch assembly 10. In particular, in this embodiment, the wafers of lock plug 111 are extended when key 119 is removed, and in this manner, rotation of lock plug 111 is prevented when the wafers are received in the groove 150 of sleeve 113. The wafers of lock plug 111 are retracted away from the groove 150 in lock plug sleeve 113 by insertion of key 119, which allows for subsequent rotation of lock plug 111 relative to lock plug sleeve 113.

Positioned coaxially between the housing 30 and the sleeve-like cam 20 is a motion control sleeve 40 having a pair of motion control slots. Each motion control slot has an axial slot portion 41 and a circumferencial slot portion 42. Each of the axial portions 41 extends in a direction parallel to the longitudinal axis of the housing 30, and each of the circumferencial slot portions 42 extends along a length of arc of a circle formed in a plane perpendicular to the longitudinal axis of the housing 30, with the latch assembly 10 in the fully assembled configuration. In the present embodiment, the motion control slots are spaced 180° from one another. The end of each axial slot portion 41, located distally from the first end of the housing 30, connects with one end of a respective one of the circumferencial slots 42. The latch assembly 10 further includes means for substantially preventing rotation of the motion control sleeve 40 relative to housing 30. In this embodiment, the sleeve 40 includes two notches 152 at its lower end and which rest on two tabs 160 on the bottom interior of housing 30. The latch assembly 10 further includes means between the motion control sleeve 40 and lock plug sleeve 113 for substantially preventing rotation of lock plug sleeve 113 relative to housing 30. In this embodiment, the sleeve 40 includes a pair of notches 44 at its upper end and which receive ears 140 which project axially from the distal end of lock plug sleeve 113. The fixed motion control sleeve 40 may also be provided integral with the housing 30 being formed directly within or extending from an inner surface of the housing 30. The slot portions 41 and 42 in the motion-control sleeve 40 function respectively as rotational motion-control slots and as axial motion-control slots.

Shaft 50 is elongated and projects outward from the second end of the housing 30 by passing through the central hole at the second end 32 of housing 30. The shaft 50 is supported such that the longitudinal axis of the shaft 50 coincides with the longitudinal axes of the housing 30, the motion-control sleeve 40, and the cam 20. At least the majority of the portion of the shaft 50 which lies outside the housing 30, is provided with interrupted screw threads. The screw threads of the shaft 50 are interrupted by a pair of flats machined on either side of at least the threaded portion of the shaft 50. The threaded portion of the shaft 50 fits through a hole in one end of the pawl 70. The hole in the end of the pawl 70 has flat sides which match the flats on either side of the shaft 50. Thus, relative rotation between the pawl 70 and the shaft 50 is prevented, and the pawl 70 and the shaft 50 rotate about the longitudinal axis of the shaft 50 as a unit. The interrupted screw threads on the shaft 50 are engaged by the mounting nuts 71 in order to secure the pawl 70 in place at a desired location along the length of the threaded portion of the shaft 50.

The relative positions of the motion-control sleeve 40 and cam 20 could be reversed. That is, motion-control sleeve 40 could be inside of cam 20 rather than outside as shown. Mounted on the shaft 50 is the cross-pin 60 which projects laterally from opposite sides of the shaft 50 and functions as both a cam follower and as a motion-control pin. Cross-pin 60 cooperates with the cam 20 and the motion control sleeve 40 to control whether, in response to rotation of the lock plug 111, the shaft 50 and pawl 70 will move only axially or only rotationally. This is determined by whether the opposite ends of pin 60 are positioned through the axial slot portions 41 or through the circumferencial slot portions 42.

The housing 30 is mounted on the closure member by retaining means which, in the present embodiment, is comprised of a washer and a mounting nut engaging the threads on the outer surface of housing 30. In the present embodiment, the housing 30 is installed in a closure member by positioning the latch assembly 10 such that the housing 30 extends through an aperture passing through the closure member. The latch assembly 10 is installed such that the first end of the housing 30 is accessible by a user for insertion of the key 119. The installation of the latch assembly 10 is most easily accomplished when the pawl 70 is not mounted on the shaft 50, so that the shaft 50 can be inserted first through the aperture in the closure member. The pawl 70 can then be mounted to the shaft 50 after the housing 30 is positioned to extend through the aperture formed in the closure member, however, this sequence of steps for the installation of the latch assembly 10 is not a requirement. The housing 30 is then secured within the aperture of the closure member by the mounting nut and, if desired, also the washer.

In the present embodiment, the components of the latch assembly 10 are preferably comprised of metal and metal alloy materials, however, other suitable materials can also be used where desired. In addition, in the present embodiment, the closure member can be comprised of any suitable materials, such as wood or metal, and can be of varying thickness.

The operation of the latch when installed as part of an assembly including a closure member, will now be described. When lock plug 111 is rotated, as by the key 119, the sleeve-like cam 20 will be driven to rotate in the same direction as the lock plug 111. When cam 20 is rotated, cross pin 60 is moved, but whether the movement is axial or rotational is dependent upon whether the ends of pin 60 are in the axial slot portions or in the circumferencial slot portions of the motion-control sleeve 40.

When in the latched position, lock plug 111 is at its fully clockwise position, and the two opposite ends of cross pin 60 are positioned through the axial slot portions 41 of the motion-control sleeve 40, near the ends of the axial slot portions 41 which are closest to the first end of the housing 30. In addition, the portions of the cross pin 60 projecting from either side of the shaft 50, simultaneously engage the cam slots 25 of the cam 20. At the extreme of the clockwise rotation of the lock plug 111, the projecting portions of the cross pin 60 are positioned nearest to the ends of the cam slots 25 which are closest to the proximal end of the cam 20. The pitch of each of the cam slots 25 is such that the axial distance, i.e. the distance measured in a direction parallel to the longitudinal axis of the cam 20, between a location along the cam slot 25 and the proximal end of the cam 20 increases in the clockwise direction, beginning at the end of the cam slot nearest the proximal end of the cam 20.

To unlatch the closure member from, for example, the cabinet frame, lock plug 111 is turned in a counterclockwise direction. When this is done, lock plug 111 and cam 20 rotate as a unit. The cross pin 60 cannot move rotationally because its opposite ends are within the axial slot portions 41 of the stationary motion-control sleeve 40. As a result, when cam 20 is rotated counterclockwise, the opposite ends of pin 60 follow the opposed cam slots 25, and as a result, pin 60, and hence also shaft 50 and latch pawl 70, will move away from the first end of the housing 30 in a direction parallel to the longitudinal axis of the shaft 50. The axial movement of the shaft 50 and the pawl 70, away from the first end of the housing 30 and away from the frame of the closure member, continues until the ends of the pin 60 reach the circumferencial slot portions 42.

After lock plug 111 and cam 20 have been rotated as a unit through approximately 120 degrees, cross pin 60 has moved axially away from the proximal end of the motion control sleeve 40, and is now aligned with the opposed circumferencial slot portions 42. Further rotation of lock plug 111 and cam 20 now causes rotational movement of cross pin 60, shaft 50 and pawl 70, as the ends of pin 60 move along the opposed circumferencial slot portions 42. In this manner, pawl 70 is moved out of alignment with the frame member, and after approximately 60 degrees of rotation, the closure member or door is fully unlatched. Lock plug 111 has now been rotated approximately 180° relative to its fully latched position.

The latching action is simply the reverse of the unlatching action just described. On latching, as lock plug 111 is turned clockwise, the opposite ends of cross pin 60 move in the clockwise direction along the circumferencial slot portions 42 and the shaft 50 rotates in the clockwise direction about its longitudinal axis. Then the cross pin 60 translates axially toward the proximal end of the motion control sleeve 40, when the cross pin 60 reaches the axial slot portions 41. These sequential motions are caused by the walls 22 of the cam slots 25, which urge the ends of the cross pin 60 along the circumferential slot portions 42 in the clockwise direction, until the ends of the cross pin 60 abut against the edge of the axial slot portions 41. Thereafter, walls 22 of the cam slots 25 urge the ends of the cross pin 60 axially toward the proximal end of the motion control sleeve 40 along the axial slot portions 41. Thus, cam 20 and the motion-control sleeve 40 cooperatively cause the rotational and axial motions of the shaft 50 to take place in sequence, in response to the rotational motion of the lock plug 111 in the latching or clockwise direction, in one continuous motion.

The new latch assembly has been described as mounted on a movable door. This is the preferred location. However, a latch embodying the basic concept of the present invention could be mounted on the fixed cabinet rather than on the door. In such case, the shaft and latch pawl would be moved rotationally to engage a keeper mounted on the inside of the door and then axially away from the first end of the housing 30 to push the door to the tightly closed position. This is the reverse of the axial motion used to pull the door tightly shut when the latch is mounted on the door. When the latch 10 is used in this mode, the closure member will be latched in the counter clockwise direction and unlatched in the clockwise direction. The latching and unlatching directions of the latch 10 can be reversed by simply reversing the pitch of the cam slots 25 and the direction in which the axial slot portions 41 extend relative to the circumferencial slot portions 42. Clockwise and counter clockwise directions as used herein refer to the direction of rotation as perceived by a viewer facing the key hole of the lock plug 111.

Figures 40, 41, 42:
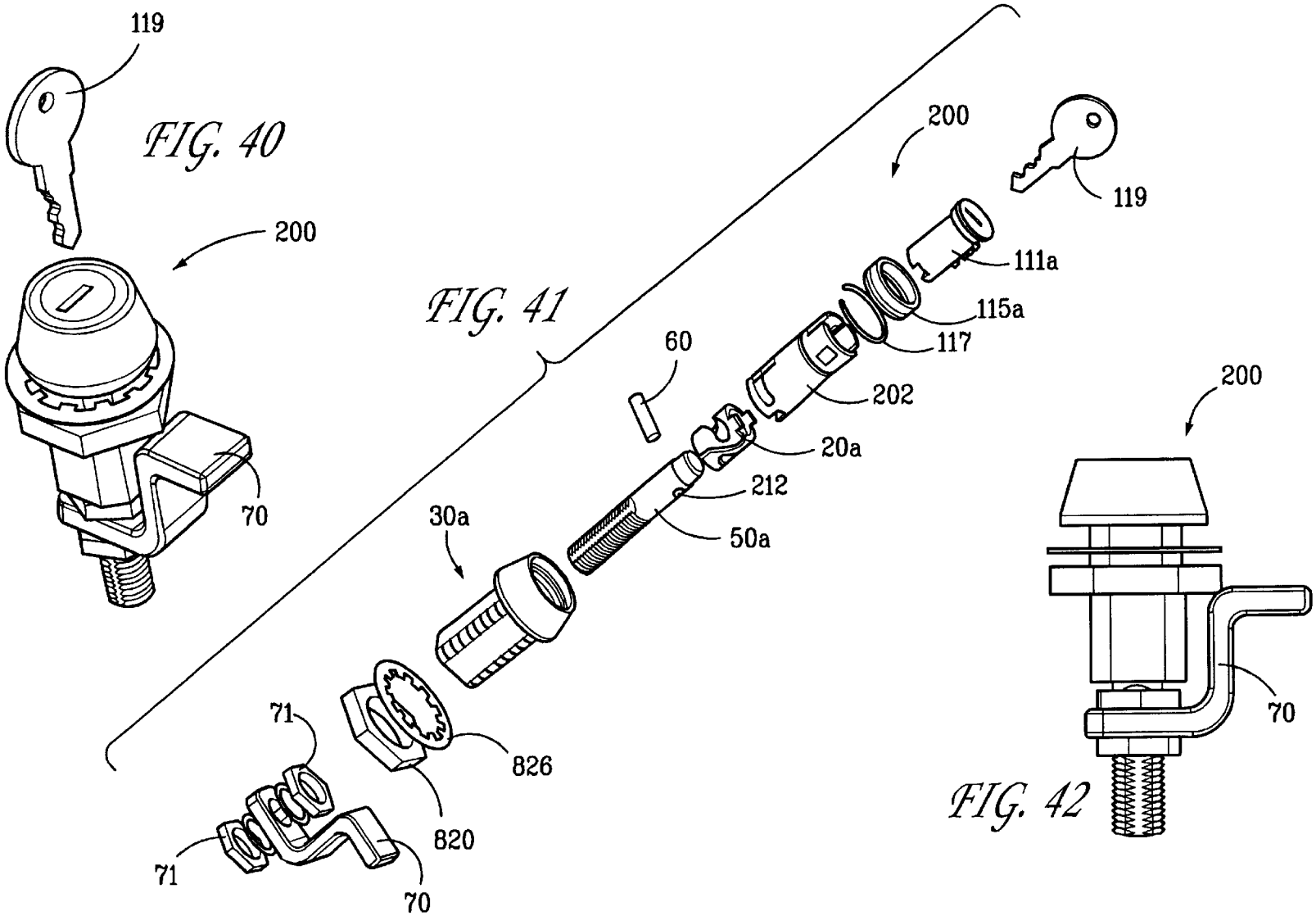
FIG. 40 is a perspective view of a latch assembly in accordance with a second embodiment of the present invention.
FIG. 41 is an exploded view of the latch assembly of FIGS. 40 and 42.
FIG. 42 is a side elevational view of the latch assembly of FIG. 40.
Figure 45:
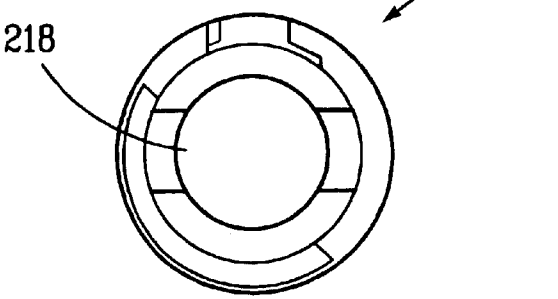
FIGS. 43–45 are views of the lock plug of the latch assembly of FIG. 40.
Figure 43:
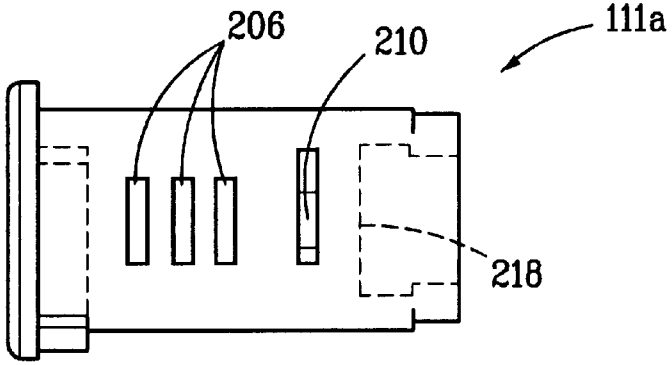
Figure 44:
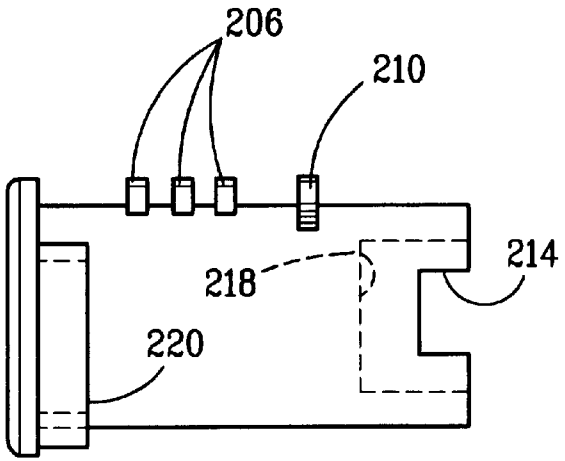
Figure 50:
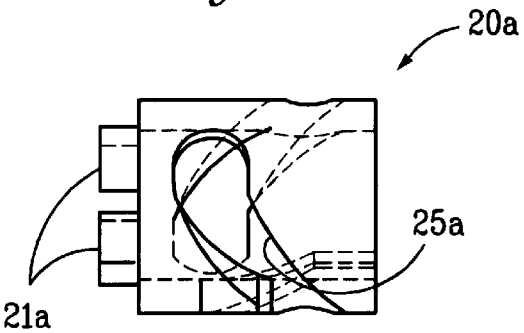
FIGS. 50–51 are views of the cam of the latch assembly of FIG. 40.
Figure 51:
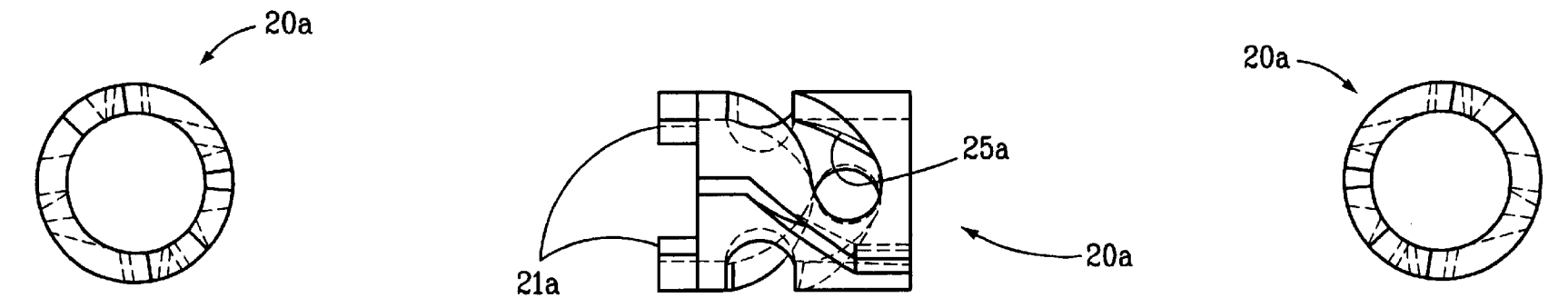
Figure 53:
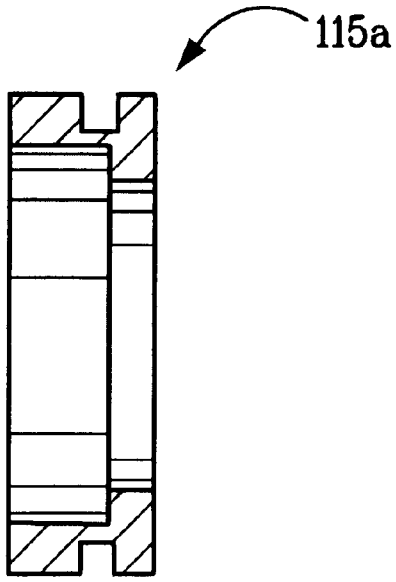
FIGS. 52–53 are views of the bushing of the latch assembly of FIG. 40.
Figure 52:
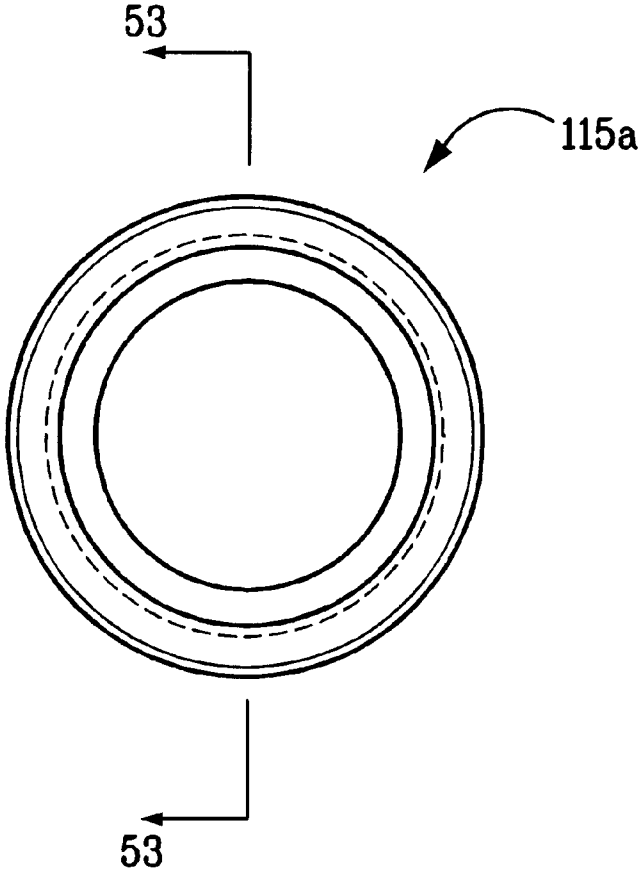
Figure 54:
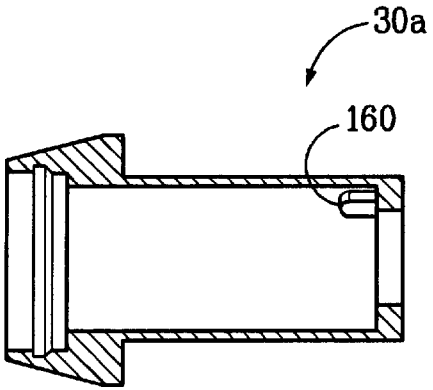
FIGS. 54–57 are views of the housing of the latch assembly of FIG. 40.
Figure 55:
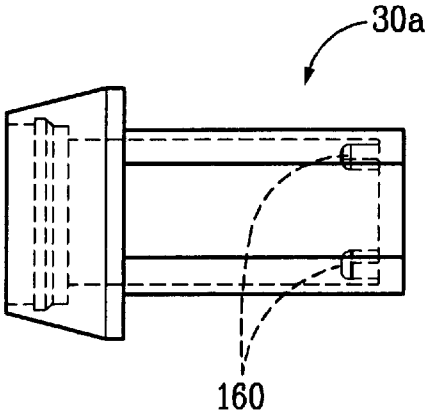
Figure 56:
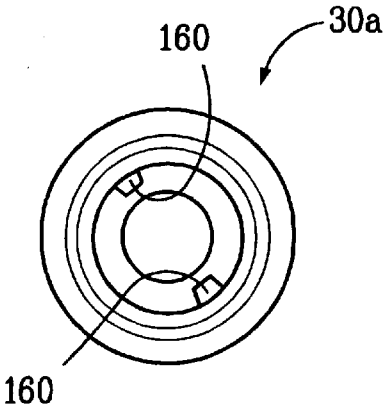
Figure 57:
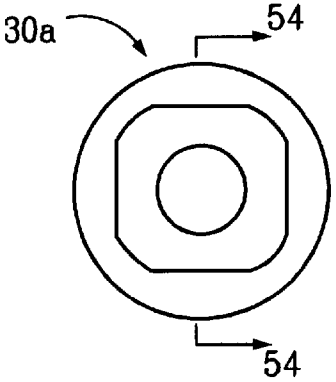
Figure 58:
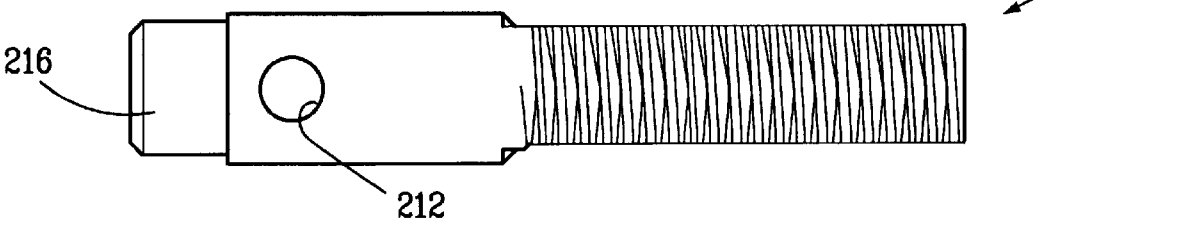
FIGS. 58–60 are views of the shaft of the latch assembly of FIG. 40.
Figure 59:
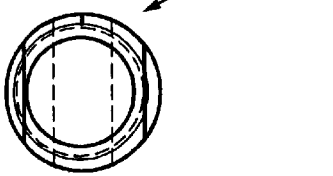
Figure 60:
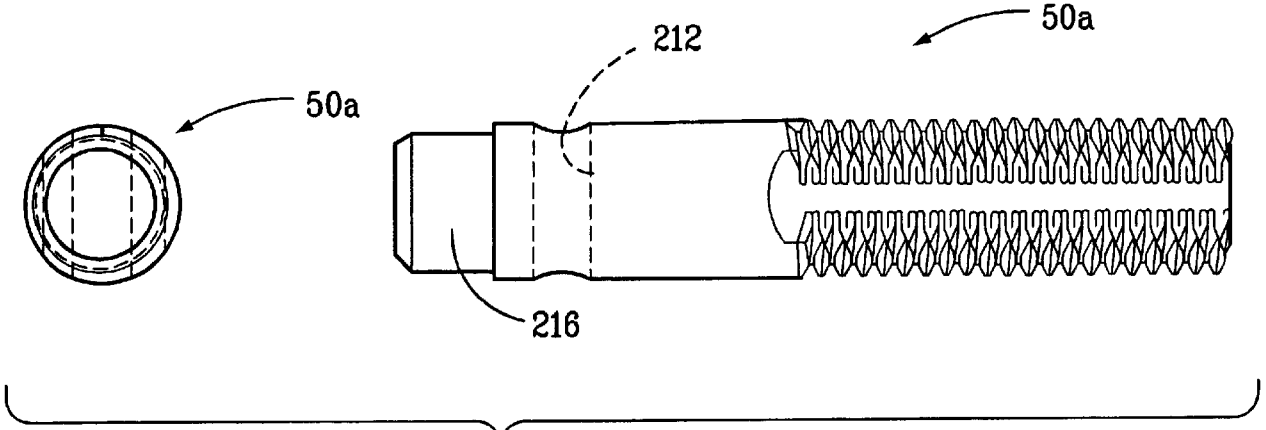

Referring to FIGS. 40–60, a second embodiment 200 of the latch of the present invention can be seen. The latch 200 operates in essentially the same manner as described for the latch 10, the only major difference being that the lock plug sleeve 113 and the motion control sleeve 40 are combined into a combined lock plug and motion control sleeve 202 of unitary (i.e. one-piece) construction. The latch 200 includes a housing 30*a*, a retainer bushing 115*a*, a combined lock plug and motion control sleeve 202, a lock plug 111*a*, a retainer ring or clip 117, cam 20*a*, shaft 50*a*, and cross-pin 60. The sleeve 202 surrounds the Lock Plug 111*a* and the cam 20*a* and is fixed against rotation by projections 160 inside the Housing which engage notches 152. The function of the Sleeve 202 is to provide clearance slots 204 for the Lock Plug wafers 206 and provide a shoulder 208 for the Lock Plug retaining wafer 210 to engage. The sleeve 202 also has the motion control slots having axial portions 41 and circumferential portions 42, thus combining the functions of the motion control sleeve and the Lock Plug Sleeve in one piece. The slot portions 41 and 42 provide for the operational motion control in the same manner as described for latch 10, and the arcuate slot 208 extends over enough degrees of arc to provide for rotation of the lock plug over its operational range of rotation while providing a shoulder which is caught by the retaining wafer 210 to prevent the lock plug from being pulled out by unauthorized persons. When the key 119 is removed from the lock plug 111*a* with the latch 200 in the fully latched configuration, the wafers 206 engage slots 204 to prevent rotation of the lock plug 111*a* and thus opening of the latch 200. The Sleeve is secured against being pulled out of the housing 30*a* by the Bushing 115*a* and Retaining Ring 117 at the top of the housing. The Cam 20*a* and the slot portions 41 and 42 of the Sleeve 202 provide sequential rotation and pull-up (i.e. axial translation) to the shaft 50*a* via the cross-pin 60 which is positioned through the hole 212 in the shaft 50*a*. The Lock Plug 111*a* has slots 214 in the inner end to mate with the tabs 21*a* on the cam 20*a*. The Retaining Bushing 115 and Retaining Ring 117 are similar to that previously described for latch 10. As with the latch 10, the inserted key 119 acts as a knob which is turned 180 degrees to operate the latch 200 through the rotation and pull up motion (i.e. axially outward motion).

It should be noted that the cam 20*a*, while similar in design, is slightly different from the cam 20 in that it is designed such that the cam slots 25*a* rise from their low seats to their high seats in 110 degrees of rotation instead of 120 degrees. Likewise, the motion control slot portions 41 and 42 in the Sleeve 202 of latch 200 limits the rotation of the shaft 50*a* to 70 degrees instead of 75. The significance of these changes is that the total rotation of the cam 20*a* and the Lock Plug 111*a* is 180 degrees instead of 195. This is preferred with lock plugs that only permit the key to be removed when the lock plug has rotated 180° from either its latch or unlatched position. In such cases accomplishing the entire latching or unlatching operation in 180° allows the key to be removed from the lock plug in both the fully latched and unlatched positions.

The advantages of the one piece design of the sleeve 202 are that there are fewer pieces to handle and mate together at assembly, and that this design more rigidly supports the Lock Plug than the two pieces of latch 10 that are engaged together by tabs fitting into slots.

The Shaft 50*a* is also modified from that of latch 10. The end of the shaft 50*a* is extended with a reduced diameter portion 216. The lock plug 111 a has a recess or cavity 218 which receives the reduced diameter portion 216 of the shaft 50*a* when the shaft 50*a* is in the fully latched or pulled-up position. When the Shaft 50*a* is in the pulled-Up (latched) position, the end 216 of the Shaft 50*a* seats in the recess 218 of the lock plug to support the Shaft 50*a* against the bending load transferred from the Pawl 70 to the Shaft 50*a*.

Figure 61:
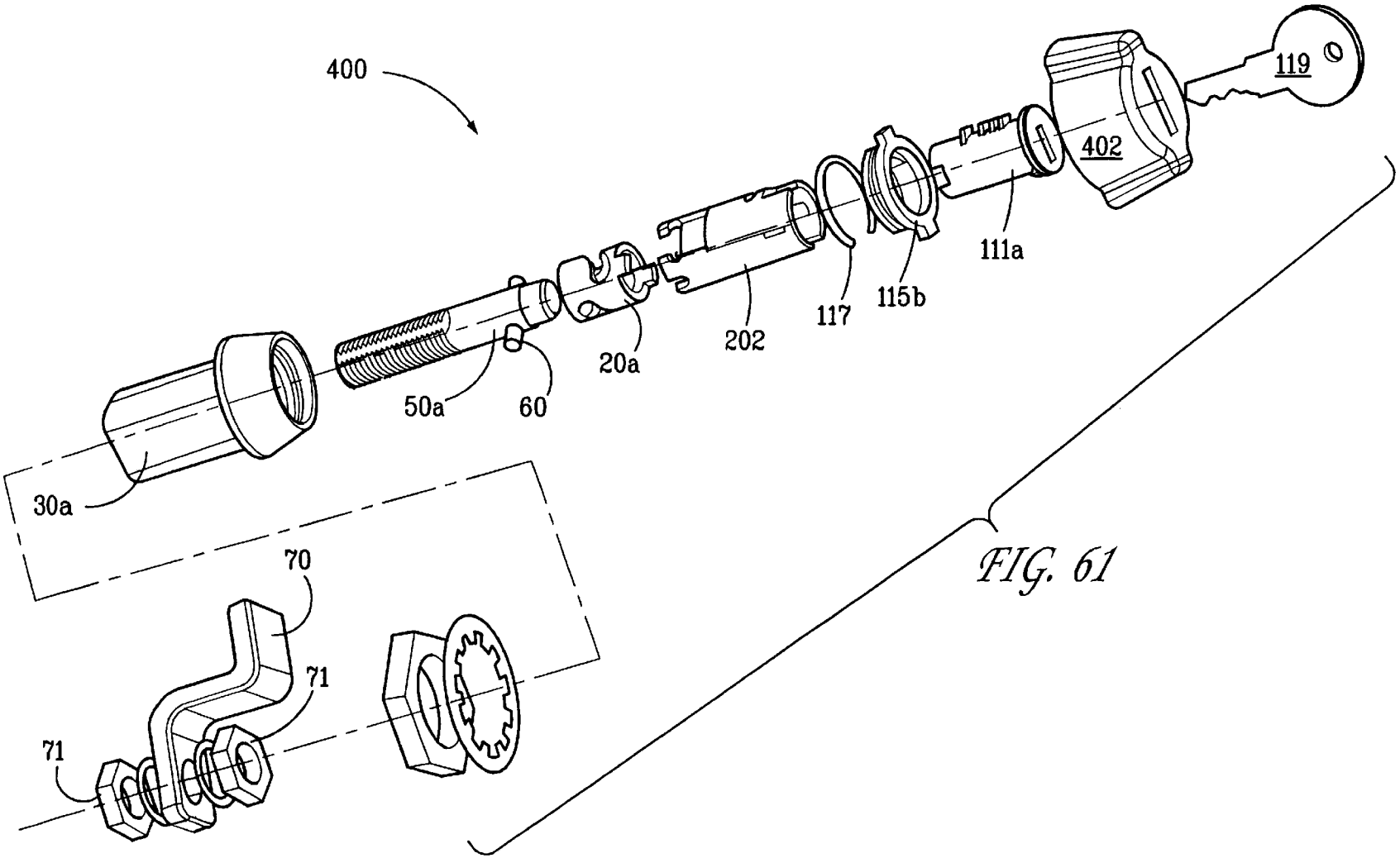
FIG. 61 is an exploded view of a latch assembly in accordance with a third embodiment of the present invention.
Figure 62:
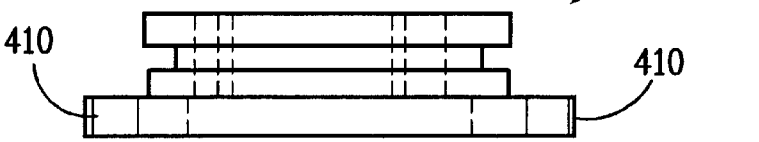
FIGS. 62–64 are views of the bushing of the latch assembly of FIG. 61.
Figure 64:
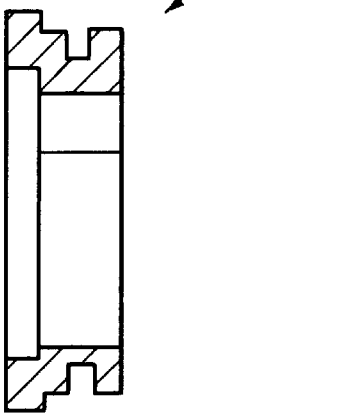
Figure 63:
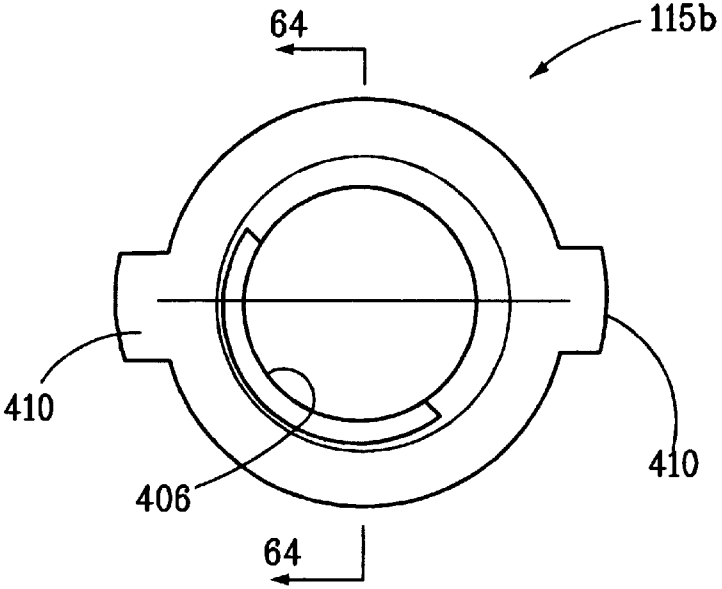
Figure 68:
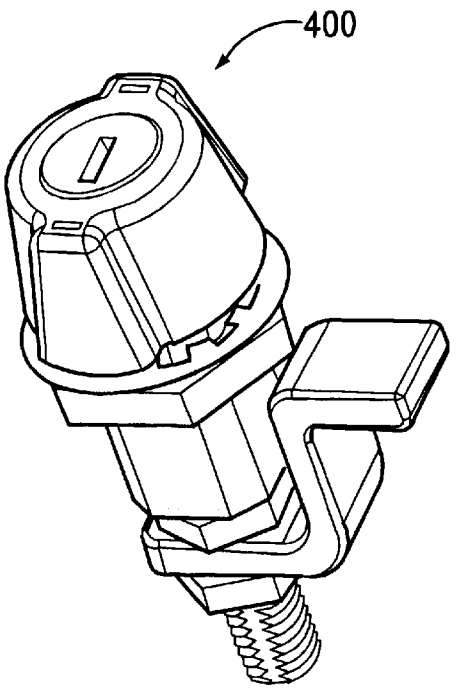
FIGS. 66–68 are exterior views of the latch assembly of FIGS. 61 and 65 in assembled condition.
Figure 67:
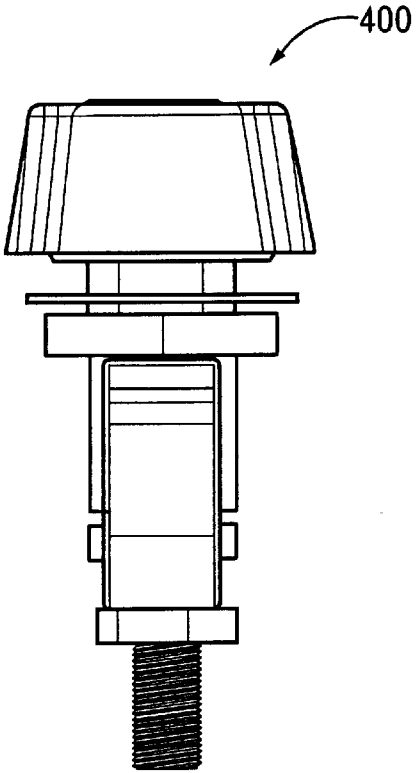
Figure 66:
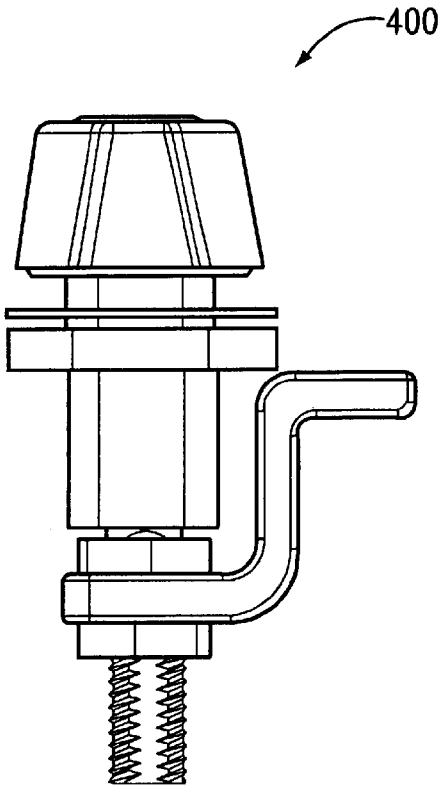
Figure 70:
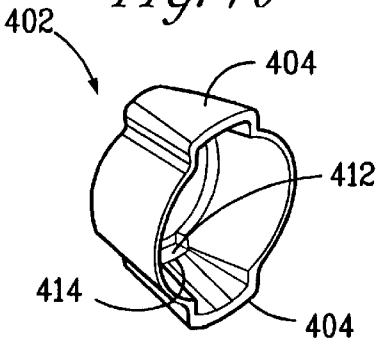
FIGS. 69–74 are views of the wing-knob of the latch assembly of FIGS. 61 and 65.
Figure 69:
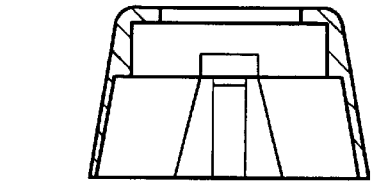
Figure 72:
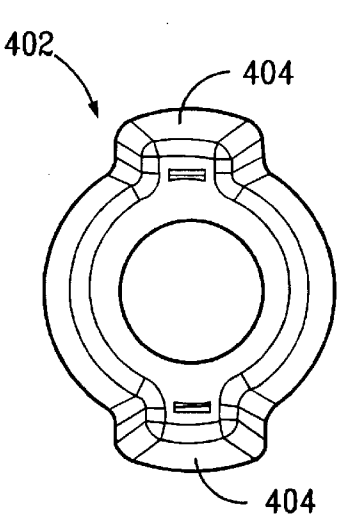
Figure 71:
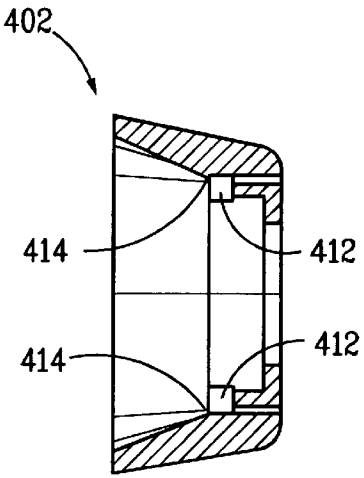
Figure 73:
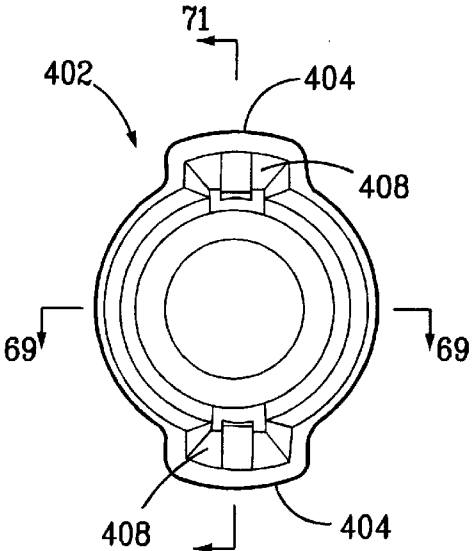
Figure 74:
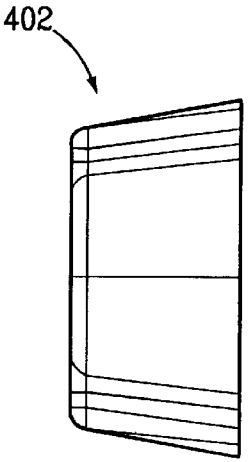
Figure 88:
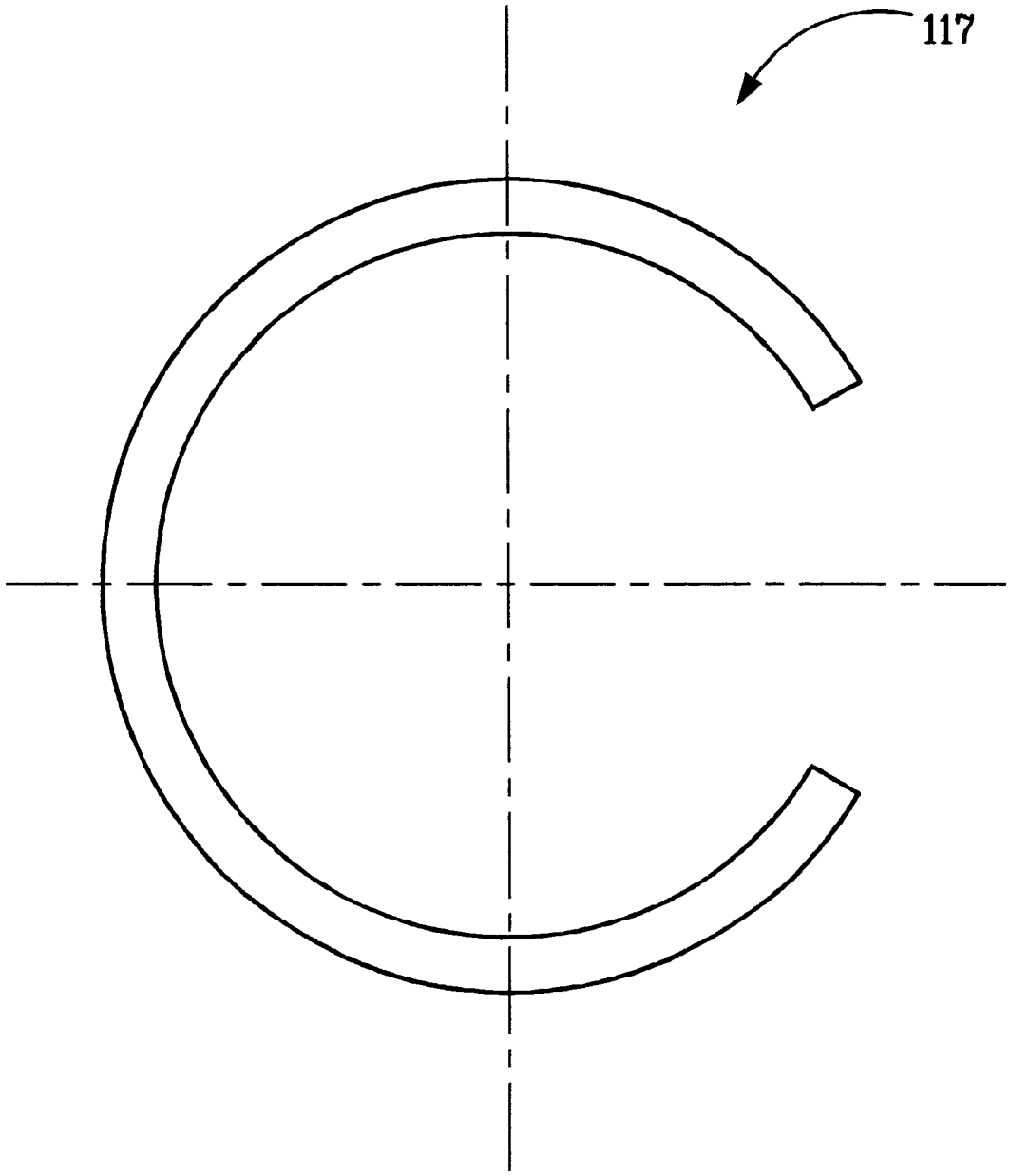
FIG. 88 is a plan view of the retainer of the latch assembly of FIGS. 40, 61 and 65.
Figure 89C:
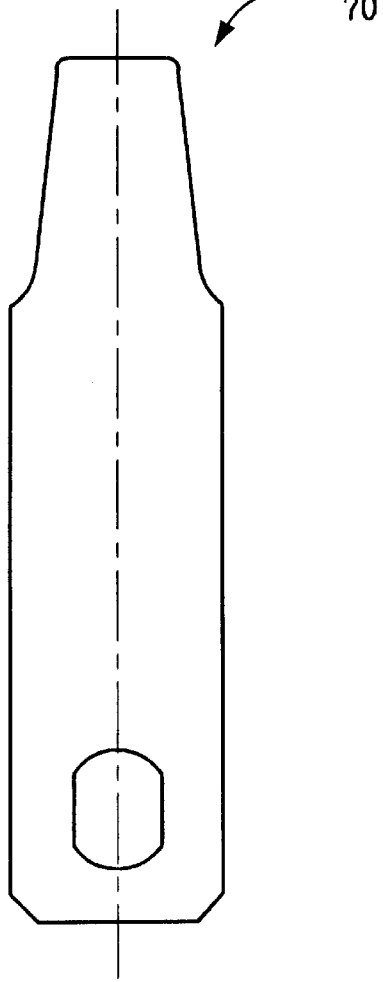
FIGS. 89A–89C are views of a pawl usable with the latch assembly of FIGS. 40, 61 and 65.
Figure 89B:
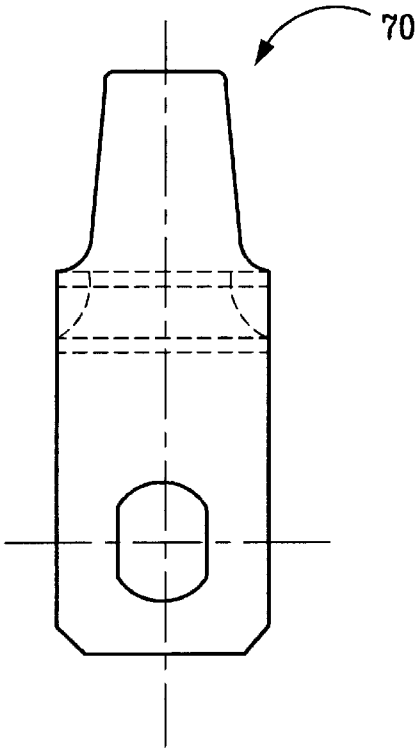
Figure 89A:
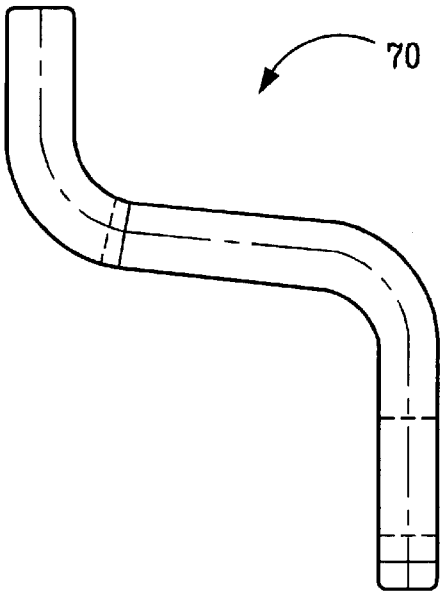

Referring to FIGS. 46–51, 54–60, 61–64, 66–74, 88, and 89A–89C, a third embodiment 400 of the latch of the present invention can be seen. A wing-Knob 402 is fixed to the Lock Plug 111*a* via a Tab Bushing 115*b*. The Knob 402 and Key 119 rotate together to operate the latch; the knob 402 affording more purchase and strength for higher operating torque.

The knob 402 has wings 404 that give the user operating the latch a better grip and the ability to impart more torque to the lock plug 111*a* without the risk of breaking the key 119 in the lock plug.

In the latch 400, the bushing 115*b* has a sector shaped recess 406 which mates with the sector shaped projection 220 on lock plug 111*a*. Thus the lock plug and the bushing 115*b* rotate as a unit. The wings 404 form hollow channels 408 on either side of the center cavity of the knob 402. The hollow channels 408 are open at the bottom to allow insertion of the tabs 410 on either side of the bushing 115*b*. The tabs 410 are received in recesses 412 at the upper end of the channels 408. The tabs 410 snap over retaining ridges 414 as they move into the recesses 412 during assembly to thereby secure the knob 402 to the bushing 115*b*. Otherwise the latch 400 is identical to the latch 200.

Figure 65:
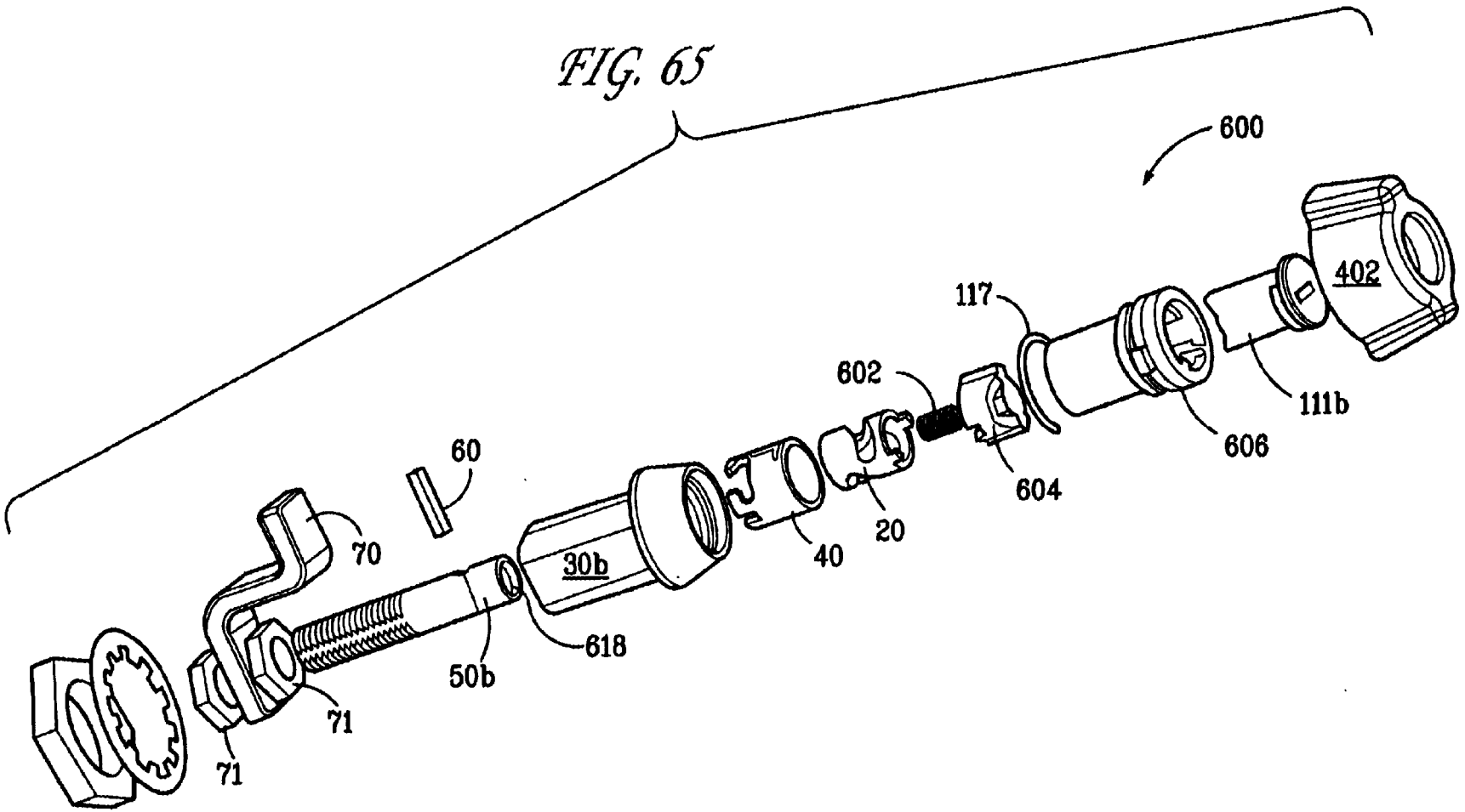
FIG. 65 is an exploded view of a latch assembly in accordance with a fourth embodiment of the present invention.
Figure 75:
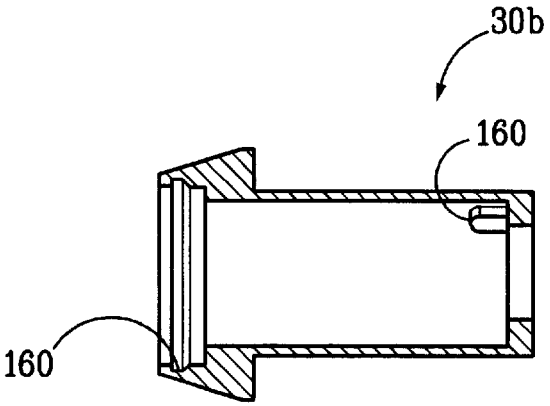
FIGS. 75–78 are views of the housing of the latch assembly of FIG. 65.
Figure 76:
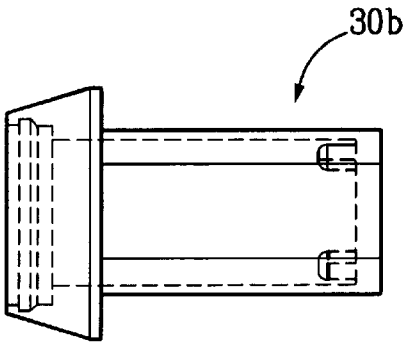
Figure 77:
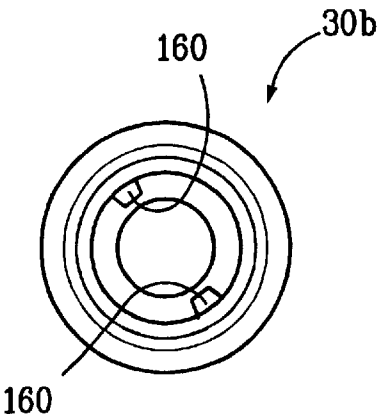
Figure 78:
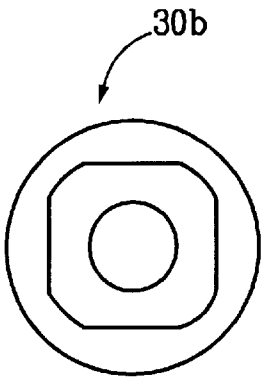
Figure 79:
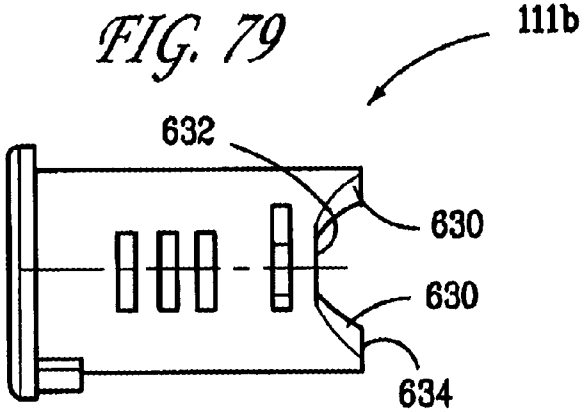
FIGS. 79–82 are views of the lock plug of the latch assembly of FIG. 65.
Figure 80:
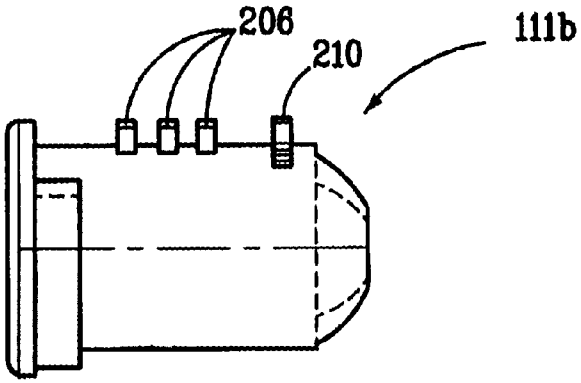
Figure 82:
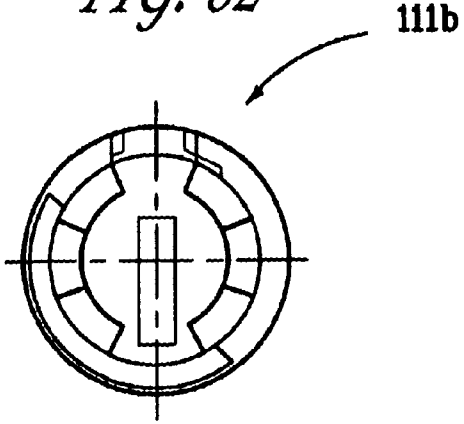
Figure 81:
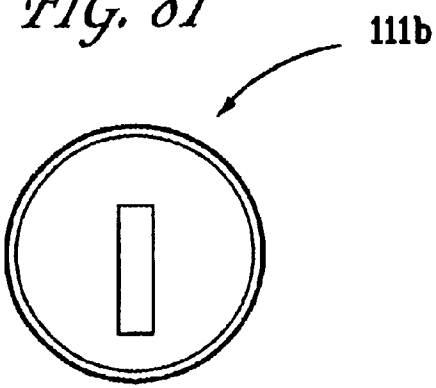
Figure 83F:
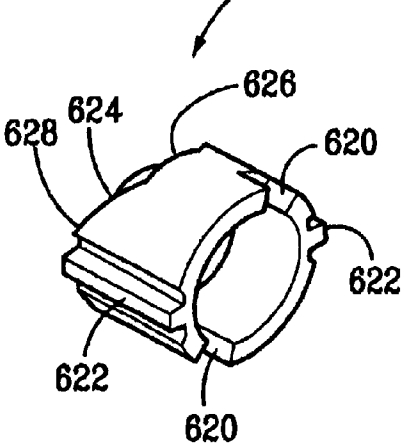
FIGS. 83A–83G are views of the lock cam of the latch assembly of FIG. 65.
Figure 83G:
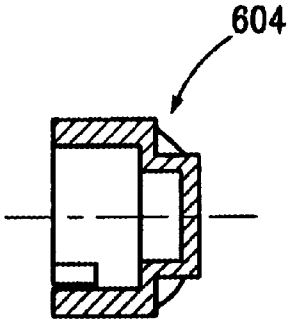
Figure 83E:
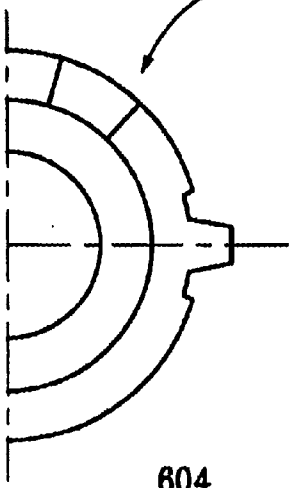
Figure 83D:
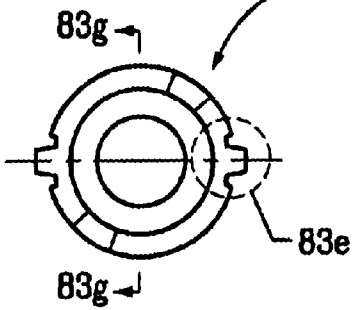
Figure 83A:
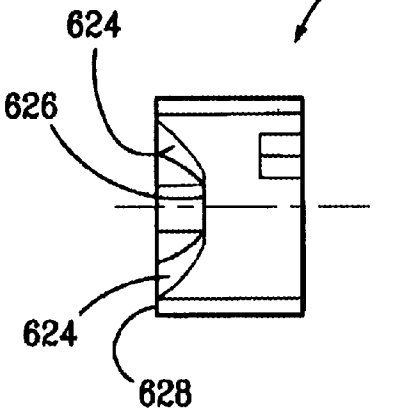
Figure 83C:
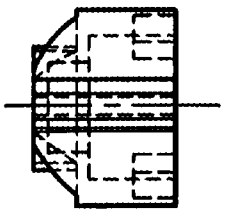
Figure 83B:
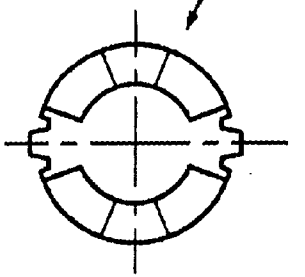
Figure 84C:
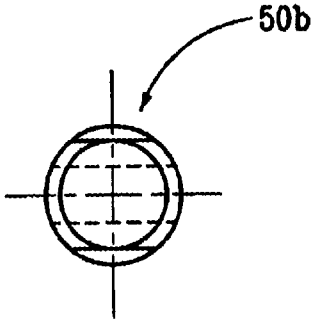
FIGS. 84A–84D are views of the shaft of the latch assembly of FIG. 65.
Figure 84A:
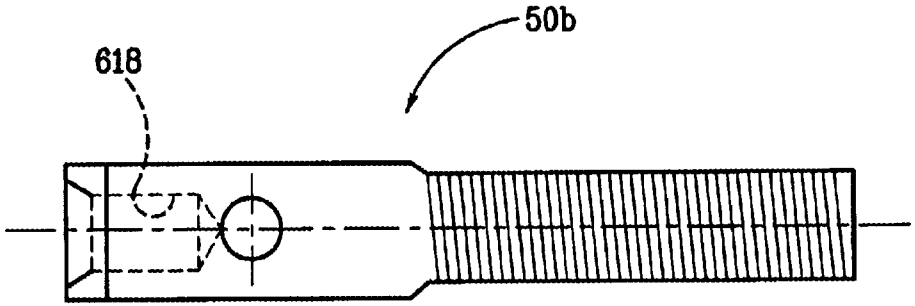
Figure 84B:
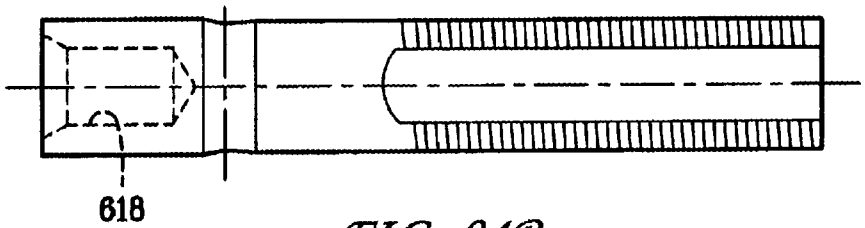
Figure 84D:
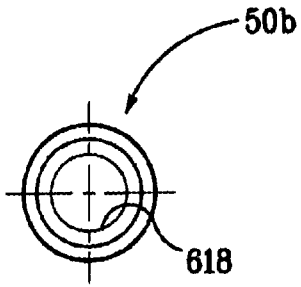
Figure 85E:
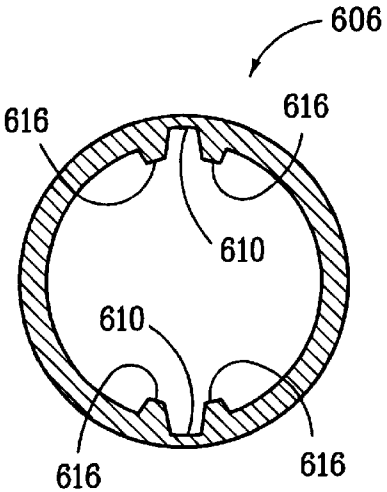
FIGS. 85A–85F are views of the driver bushing of the latch assembly of FIG. 65.
Figure 85F:
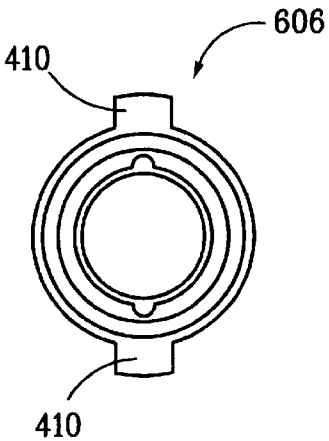
Figure 85C:
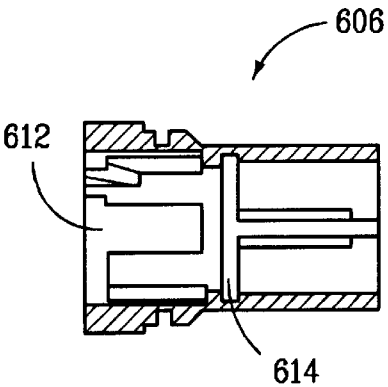
Figure 85D:
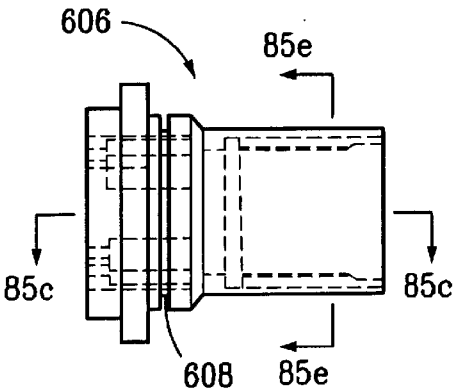
Figure 85A:
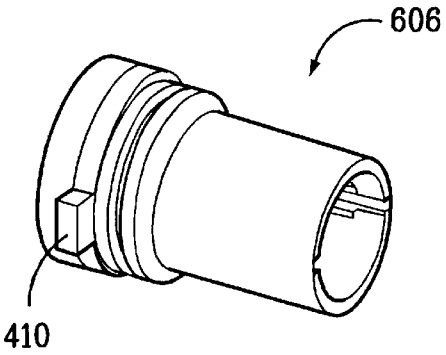
Figure 85B:
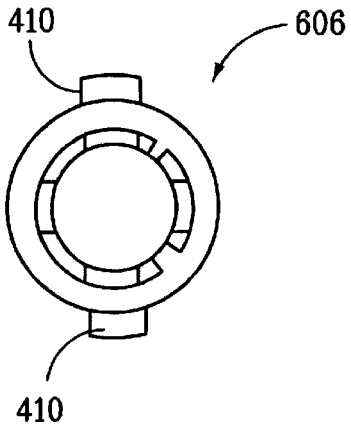
Figure 86C:
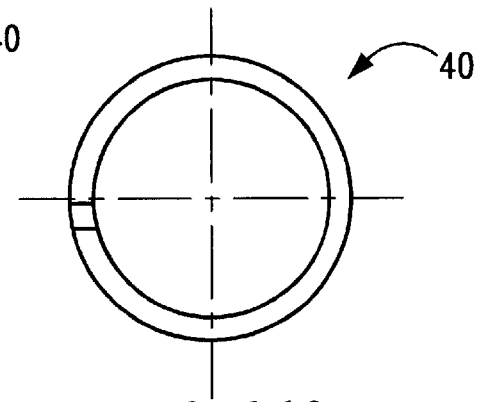
FIGS. 86A–86D are views of the motion control sleeve of the latch assembly of FIG. 65.
Figure 86B:
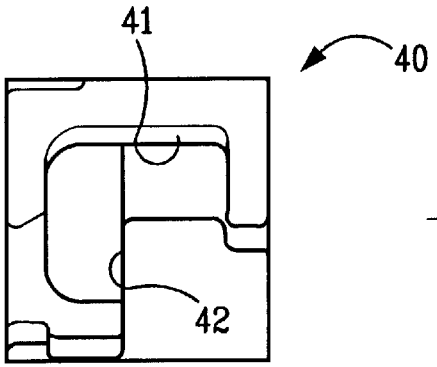
Figure 86A:
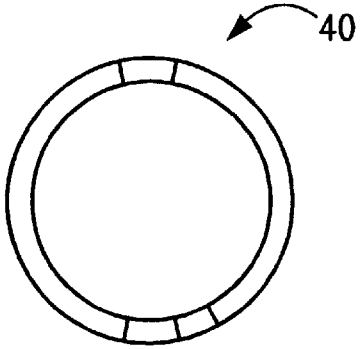
Figure 86D:
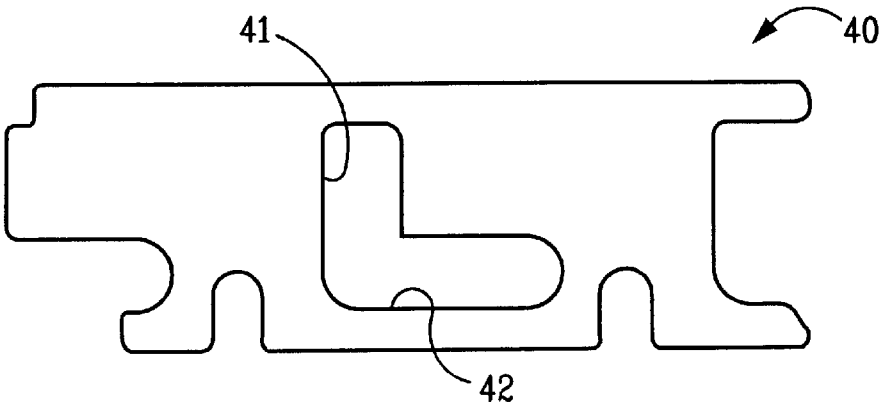

Referring to FIGS. 65–89C, a fourth embodiment 600 of the latch of the present invention can be seen. In this embodiment the Knob 402 is secured, in the same manner as previously described for the latch 400, to a driver bushing 606 having projecting tabs 410 such that the driver bushing and the knob rotate as a unit. The driver bushing 606 rotates freely relative to the housing 30*b* and is positioned over the motion control sleeve 40 to fix the longitudinal position of the sleeve 40 within the housing 30*b*. As before, the sleeve 40 is kept from rotation by projection 160.

The standard Retaining Ring 117 fits the grooves 608 and 161 of the Drive Bushing and the Housing, respectively, to retain the components inside the housing 30*b*.

This design uses the same cam 20 and motion control Sleeve 40 of the latch 10 to provide the sequential rotation and pull-up motion to the shaft 50*b*. Rotating motion applied to the Knob 402 is transmitted directly to the Drive Bushing 606 via tabs 410 that mate with notches 412 inside the Knob 402. The Knob 402 and Drive bushing 606 function as a single piece, but are separated for ease of manufacture.

The locking function is provided by the Lock Plug 111*b* and Lock Cam 604 fitted inside the Drive Bushing 606. The Drive Bushing 606 has interior grooves 612 and 614 to accommodate the locking wafers 206 and retaining wafer 210 of the Lock plug 111*b* and internal splines 616 about its inner end to control the axial motion of the Lock Cam 604. Grooves 610 are formed intermediate splines 616.

The Shaft 50*b* is similar to the shaft 50, with a counter bore 618 to receive at least a portion of the coil Spring 602. The spring 602 biases the Lock Cam 604 away from the Cam 20.

The Lock Cam 604 has notches 620 on one end to engage tabs 21 on the Cam 20. The Lock Cam 604 also has splines 622 on its outer diameter so it may slide axially relative to the drive bushing 606, but the lock cam 604 cannot rotate relative to the Drive Bushing 606. The Lock Cam 604 further has helical cam rises 624 on its outer end that extend between inner seats 626 and outer seats 628. The cam surfaces 624 cooperate with the cam surfaces 630 on the inner end of the Lock plug 111*b*. The cam surfaces 630 extend between outer seats 632 and inner seats 634. The outer end of the lock cam 604 mates with the inner end of the lock plug 111*b* when the lock plug is in the locked position relative to the drive bushing 606 such that the outer seats 632 register with the outer seats 628, the inner seats 634 register with the inner seats 626, and consequently lock cam 604 is in its outermost position under the bias of spring 602. The notches 620 are out of engagement with the tabs 21 when the lock cam 604 is in its outermost position.

When the Lock Plug 111*b* is in the "unlocked" position, the Lock Cam 604 is forced axially inward, by the cooperating surfaces 630 and 624 of the Lock Plug and Lock Cam, respectively, thus bringing the notches 620 into engagement with the tabs 21 on the Cam 20. In this condition, rotating motion of the Knob 402 and Drive Bushing 606 is transmitted through the Lock Cam 604 to the Cam to deliver the compression latching action to the shaft 50*b*.

Rotating the Lock Plug in the Drive Bushing 90 degrees to the "locked" position, the cooperating surfaces of the Lock plug and Lock Cam allow the Lock Cam to move, biased by the Spring, away from, and out of engagement with the Cam 20. In this condition, rotating motion of the Knob 402 and Drive Bushing is not transmitted to the Cam and unlatching cannot be accomplished.

The advantage of this method of locking is that it prevents the locked mechanism from being violated by simply over-torquing the knob 402. The Knob will spin with no effect when the lock plug is in the locked position relative to the drive bushing 606.

Figure 91:
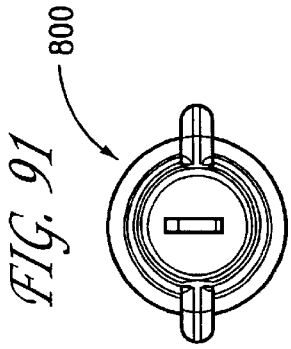
FIG. 91 is a plan view of the latch assembly of FIG. 90 in assembled condition.
Figure 92:
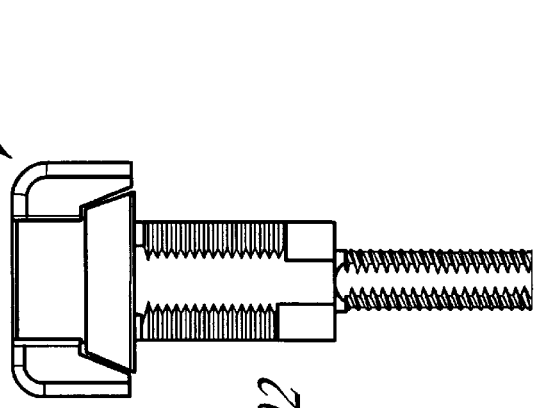
FIG. 92 is a side elevational view of the latch assembly of FIG. 90 in assembled condition.
Figure 90:
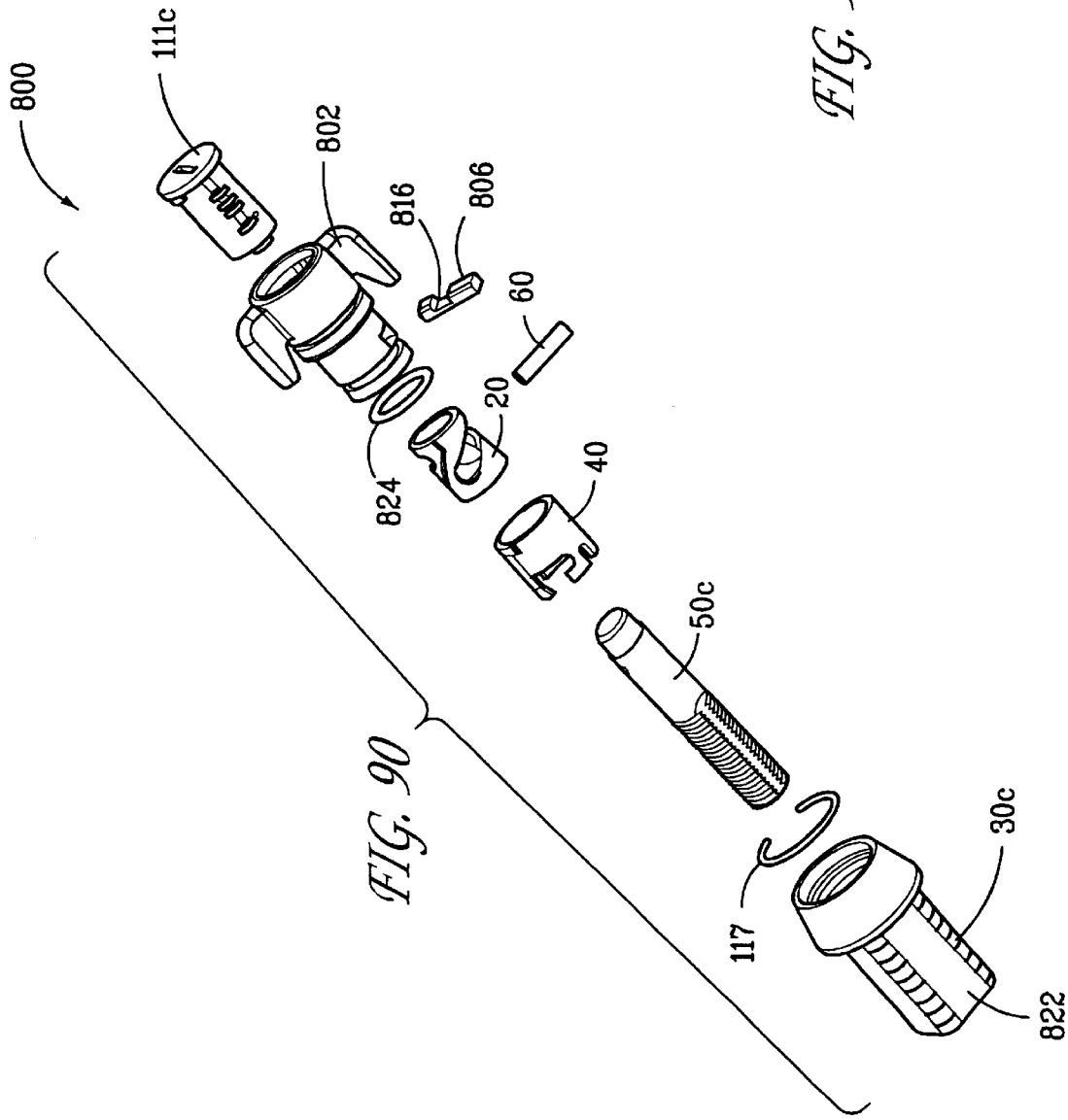
FIG. 90 is an exploded view of a latch assembly in accordance with a fifth embodiment of the present invention.
Figure 93C:
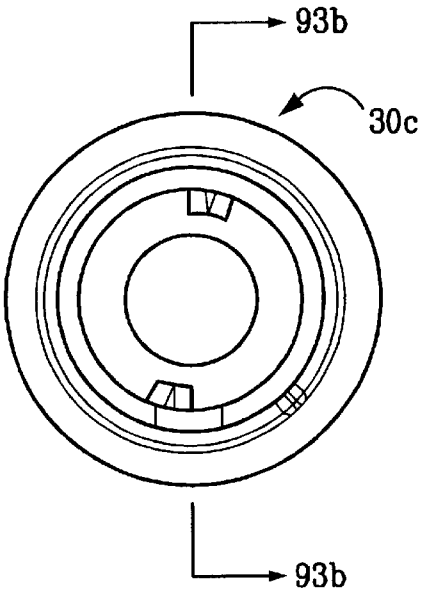
FIGS. 93A–93C are views of the housing of the latch assembly of FIG. 90.
Figure 93B:
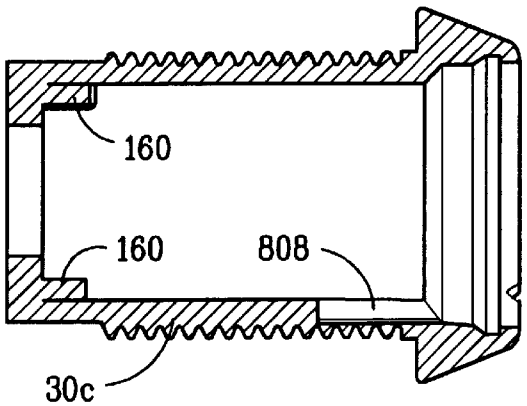
Figure 93A:
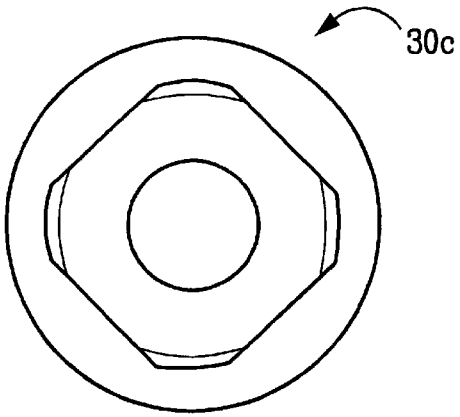
Figure 94B:
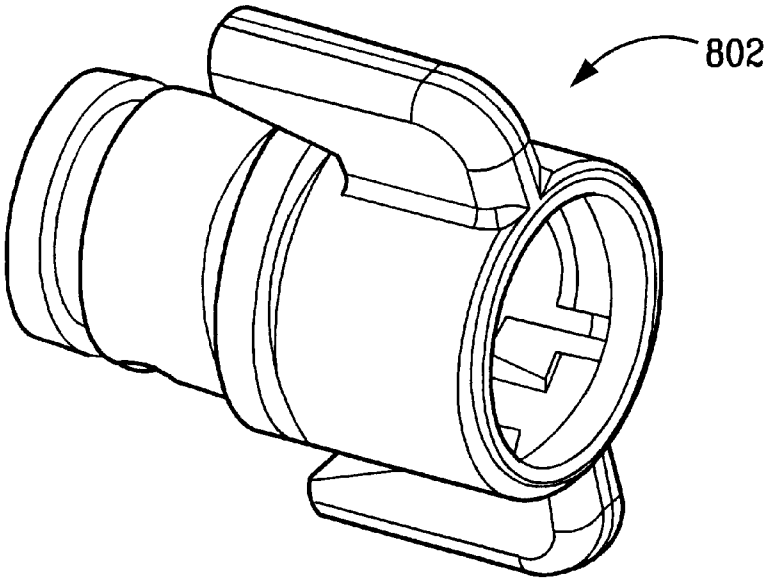
FIGS. 94A–94G are views of the wing-knob of the latch assembly of FIG. 90.
Figure 94A:
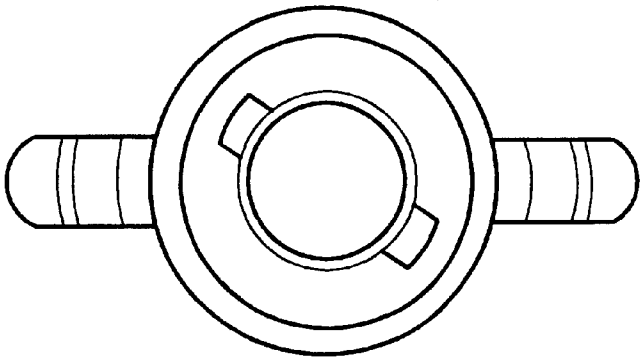
Figure 94D:
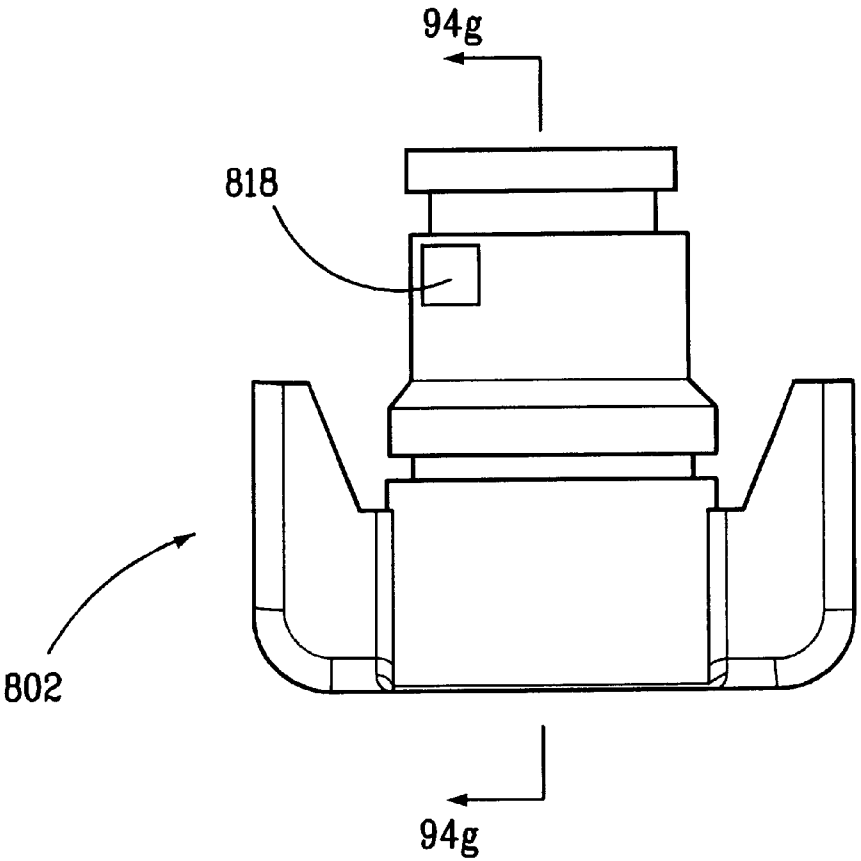
Figure 94C:
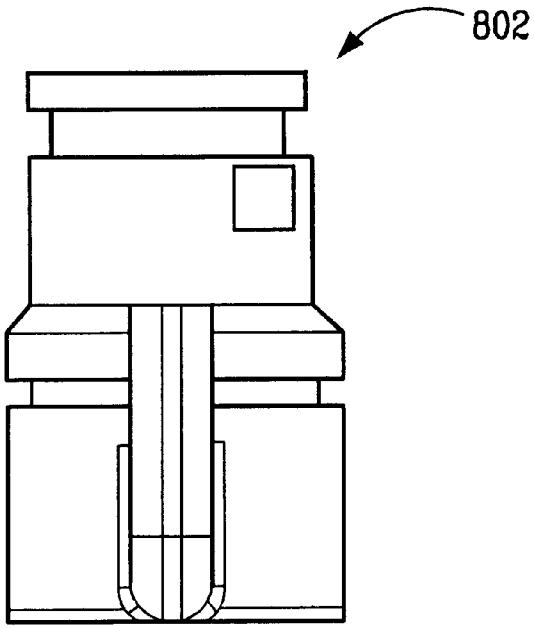
Figure 94G:
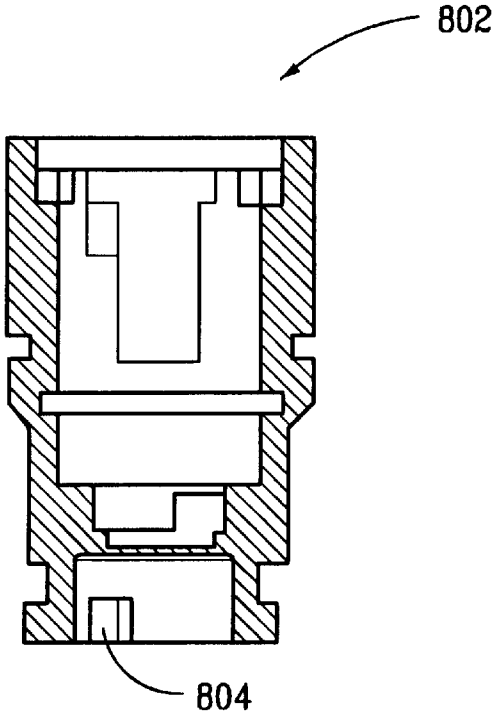
Figure 94F:
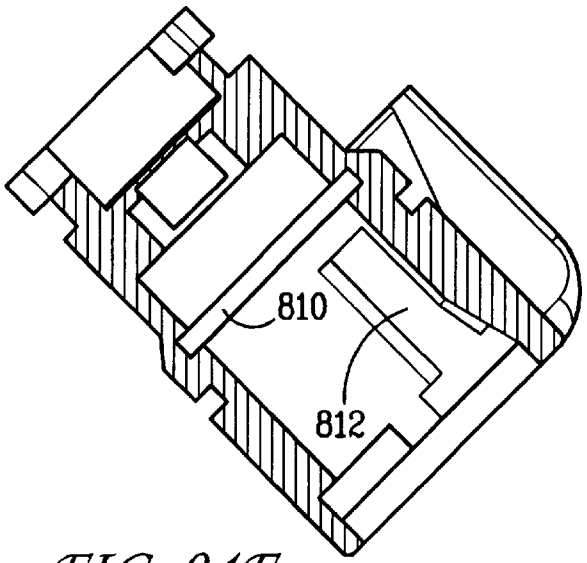
Figure 94E:
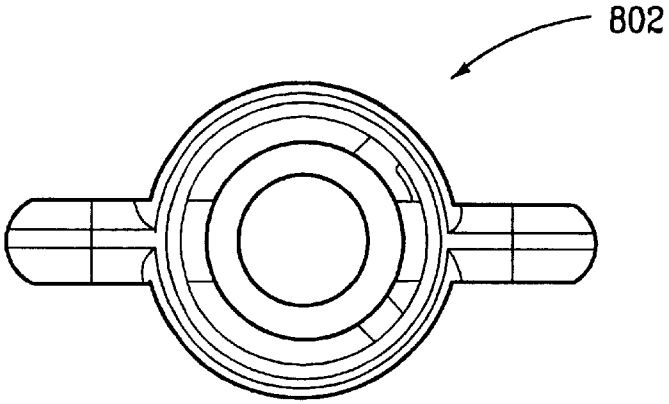
Figure 95B:
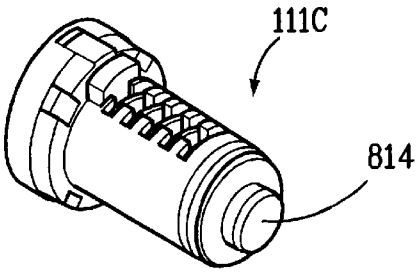
FIGS. 95A–95F are views of the lock plug of the latch assembly of FIG. 90.
Figure 95A:
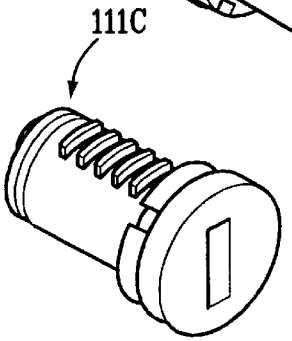
Figure 95F:
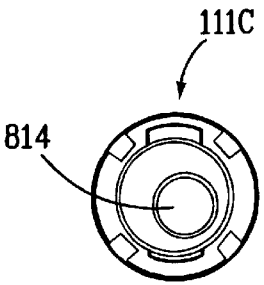
Figure 95C:
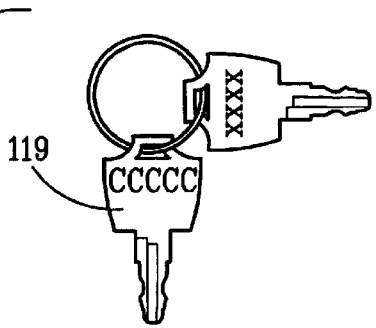
Figure 95C:
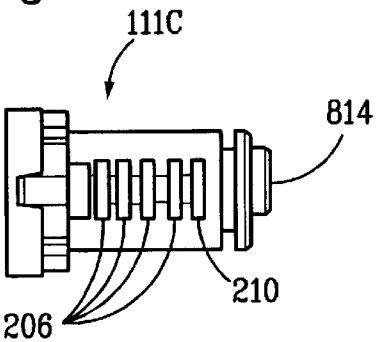
Figure 95E:
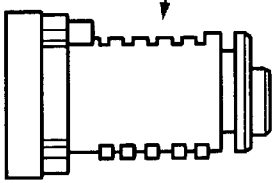
Figure 95D:
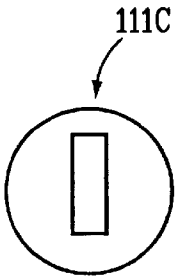

Referring to FIGS. 90–95F, a fifth embodiment 800 of the latch of the present invention can be seen. The latch 800 is similar in operation to the latch 10 except for the differences which are noted below. The Knob 802 is supported for rotational motion relative to the housing 30*c* and is retained in position by a retaining ring 117 in the manner already described in reference to the drive bushing 606. The lock plug 111*c* is housed within the knob 802 and operates a lock slide 806 to lock the winged Knob 802 against rotation when the lock plug is in the locked position relative to the knob 802. For simplicity, the Pawl and mounting hardware, that are common to all the present embodiments, are not shown.

The Retaining Ring 117 fits the grooves of the Knob 802 and the Housing 30*c* to retain the components inside the Housing.

This design uses the same Cam 20 and motion control sleeve 40 as the latch 10 to provide the sequential rotation and pull-up motion to the shaft 50*c* via the cross-pin 60. Rotating motion applied to the Knob 802 is transmited directly to Cam via tabs 21 that mate with recesses 804 in the bottom end of the Knob 802. In the unlocked condition, the Knob 802 and Cam 20 can be rotated in the Housing 30*c* from an unlatched position to a latched position to cause the Shaft 50*c* and the attached Pawl 70 to sequentially rotate and pull up (move axially outward) as described in reference to latch 10.

The locking function is provided by the lock Plug 111*c* and Lock Slide 806 fitted inside the Knob 802 and a recess

808 in the Inside Diameter of the Housing 30*c* to receive the end of the Lock Slide 806 when it is in the locked position. The top end of the Knob 802 has grooves 810 and 812 to retain the Lock Plug in the knob 802 as well as prevent rotation of the Lock Plug 111*c* when its key 119 is removed and to allow rotation of the Lock Plug when the key is inserted. Annular groove 810 receives retaining wafer 210 and longitudinal groove 812 receives the locking wafers 206 when the lock plug 111*c* is in the locked position.

The Lock Plug 111*c* has an eccentric boss 814 on its bottom end that engages a slot 816 in the top of the Lock Slide 806. The Lock Slide is pushed in and out of engagement with mating recess 808 by the rotation of the Lock Plug 111*c* relative to the winged knob 802 when the key 119 is inserted into the lock plug 111*c*. The slide 806 moves in and out of engagement with the recess 808 through a hole 818 in the knob 802.

In this embodiment, the lock slide is placed in a position below the outer plane of the mounting panel resulting in a lower profile. Because the housing of these latches has flats on the outside the slide 806 must be angled such that the recess 808 is located in the thickest portion of the housing wall. This allows the housing to be fully enclosed and sealed while permitting a recess of sufficient depth for a strong lock.

The latch 800 permits the lock slide to be placed lower in the Housing, but the slide does not protrude through the wall so that the Latch assembly may remain sealed against intrusion of water into the latched enclosure. Housings for latches in this field normally have threaded outside Diameters to receive the installation nut 820 with flats 822 to fit a shaped installation hole that prevents rotation of the housing in the door or panel. This results in a thin wall in the housing which is not suitable for an internal recess that could receive the end of a lock slide. As can be seen in the detail drawings of the knob and housing, the Lock Slide is set at an angle so that it is received into the wall of the Housing where it is thickest. Thus, the Housing wall need not be perforated, and the assembly is sealed by an o-ring 824 toward the lower end of the Knob 802. The result is a low profile, hand operated, key locking, sealed compression latch.

It will be recognized by those skilled in the art that changes may be made by the above-described embodiments of the invention without departing from the broad inventive concept thereof. It is understood, therefore, that this invention is not limited to the particular embodiments disclosed, but it is intended to cover all modifications which are within the scope and spirit of the invention as defined by the appended claims.

We claim:

1. A latch mechanism comprising:

a housing having a first end and a second end, said second end of said housing having an opening;

a lock plug supported by said housing, said lock plug being selectively rotatable between a latched position and an unlatched position using a key;

a cam having at least one cam slot, said cam being rotatably supported within said housing, said cam being coupled to said lock plug so as to rotate in response to rotation of said lock plug;

a stationary sleeve positioned within said housing and supported such that there is essentially no relative movement between said stationary sleeve and said housing when the latch mechanism is fully assembled, said stationary sleeve having means defining an edge and means for retaining said lock plug in said latched position; and a shaft positioned at least in part within said housing, said shaft extending through said opening in said second end of said housing, said shaft having at least one projection which is engaged at least to said at least one cam slot, said at least one cam slot being configured such that said shaft moves substantially rotationally as said lock plug moves from said unlatched position toward said latched position until said projection abuts said edge, thereafter said shaft moving substantially axially as said lock plug rotationally moves to said latched position.

2. The latch mechanism according to claim 1, wherein the latch mechanism is adapted for mounting to a closure member that is one of a first closure member and a second closure member, the first closure member and the second closure member cooperating with one another, said housing has a flange at said first end thereof, said housing has an exterior surface having interrupted screw threads formed thereon for engagement by a mounting nut for securing said housing in place when said housing is mounted to one of the first closure member and the second closure member.

3. The latch mechanism according to claim 1, wherein said lock plug is of the type having a key access opening and an array of wafers that retract upon insertion of a key to thereby allow rotational motion of said lock plug under the control of a user, wherein said means defining an edge defines at least one motion control slot, said edge being part of said at least one motion control slot, and wherein said means for retaining said lock plug in said latched position includes at least one groove or slot that is engaged by said array of wafers when said array of wafers are not retracted.

4. The latch mechanism according to claim 1, wherein said cam is substantially in the form of a cylindrical sleeve having a wall thickness, said can slot extends through said wall thickness of said cam said cam has a distal end and a proximal end relative to said first end of said housing, said cam has a pair of ears extending from said proximal end thereof and said lock plug has a pair of notches which matingly receive said pair of ears of said cam to thereby allow said cam to move rotationally with said lock plug.

5. The latch mechanism according to claim 4, wherein said cam slot has a proximal end closest to said proximal end of said cam and a distal end farthest from said proximal end of said cam, said cam has a longitudinal axis, and said cam slot has a pitch such that the axial distance, measured in a direction parallel to said longitudinal axis of said cam, between said cam slot and said proximal end of said cam increases in the clockwise direction, beginning at said proximal end of said cam slot, as viewed by a viewer facing said proximal end of said cam.

6. The latch mechanism according to claim 5, wherein said means defining an edge defines at least one motion control slot, said stationary sleeve has a longitudinal axis, said motion control slot has an axial slot portion extending substantially parallel to said longitudinal axis and a circumferential slot portion, said circumferential slot portion being continuous with said axial slot portion and extending from an end of said axial slot portion in a direction along a length of arc of a circle formed in a plane perpendicular to said longitudinal axis of said stationary sleeve.

* * * * *